US007927237B2

(12) United States Patent
Jenkins et al.

(10) Patent No.: US 7,927,237 B2
(45) Date of Patent: Apr. 19, 2011

(54) RETURN MACHINE FOR SPHERICAL GAMEBALLS AND TRANSPORT APPARATUS INCORPORATING THE SAME

(75) Inventors: Craig D. Jenkins, Lakewood, CO (US); Foster Brashear, Lakewood, CO (US)

(73) Assignee: Craig D. Jenkins, Lakewood, CO (US)

( * ) Notice: Subject to any disclaimer, the term of this patent is extended or adjusted under 35 U.S.C. 154(b) by 282 days.

(21) Appl. No.: 11/945,252

(22) Filed: Nov. 26, 2007

(65) Prior Publication Data

US 2009/0137347 A1 May 28, 2009

(51) Int. Cl.
*A63B 69/00* (2006.01)

(52) U.S. Cl. ..... 473/433; 473/447; 473/431

(58) Field of Classification Search ..... 473/422, 473/436, 431, 447, 479, 483, 489
See application file for complete search history.

(56) References Cited

U.S. PATENT DOCUMENTS

| | | | | |
|---|---|---|---|---|
| 1,198,300 | A | 9/1916 | Watkins | |
| 1,343,127 | A | 6/1920 | Hallinan | |
| 2,182,369 | A | 12/1939 | Barron | |
| 2,199,009 | A | 4/1940 | Perryman | |
| 2,526,018 | A | 10/1950 | Foster et al. | |
| 2,908,266 | A | 10/1959 | Cooper | |
| 3,043,592 | A | 7/1962 | Lohr | |
| 3,427,025 | A * | 2/1969 | Procter | 473/483 |
| 3,467,073 | A | 9/1969 | Rhodes | |
| 3,602,504 | A * | 8/1971 | Chapman et al. | 473/416 |
| 3,662,729 | A | 5/1972 | Henderson | |
| 3,776,550 | A | 12/1973 | McNabb | |
| 4,091,791 | A | 5/1978 | Castelli et al. | |
| 4,423,717 | A | 1/1984 | Kahelin | |
| 4,568,089 | A | 2/1986 | Jenkins et al. | |
| 4,579,340 | A | 4/1986 | Jenkins et al. | |
| 4,678,189 | A | 7/1987 | Koss | |
| 4,714,248 | A | 12/1987 | Koss | |
| 4,830,111 | A | 5/1989 | Jenkins et al. | |
| 4,913,431 | A * | 4/1990 | Jakobs | 473/433 |
| 4,938,479 | A | 7/1990 | Jenkins et al. | |
| 4,940,231 | A | 7/1990 | Ehler | |
| 5,016,875 | A * | 5/1991 | Joseph | 473/433 |
| 5,487,540 | A | 1/1996 | Bixler et al. | |
| 5,494,022 | A | 2/1996 | Sung | |
| 5,749,797 | A | 5/1998 | Sunseri et al. | |
| 5,776,018 | A | 7/1998 | Simpson et al. | |
| 5,813,391 | A | 9/1998 | Johnson | |
| 6,241,628 | B1 | 6/2001 | Jenkins et al. | |
| 6,458,049 | B2 * | 10/2002 | Bush | 473/433 |
| 7,258,633 | B2 * | 8/2007 | Joseph et al. | 473/433 |

FOREIGN PATENT DOCUMENTS

| | | | |
|---|---|---|---|
| JP | 55143283 | A | 11/1980 |

* cited by examiner

*Primary Examiner* — Mitra Aryanpour
(74) *Attorney, Agent, or Firm* — Holland & Hart LLP

(57) ABSTRACT

The present disclosure relates to a basketball return machine which may be utilized with either a goal unit or a stand-alone basketball goal. Either or both of the basketball return machine and goal unit may be fixed in location or transportable. The machine collects basketballs that are shot in the direction of a basketball goal and returns them to the user at one or more locations around the return machine's perimeter. The present disclosure eliminates the need for persons or other means being deployed to capture and return balls to persons practicing or playing a game of basketball. The present disclosure also contemplates features that permit its use in low level light or even unlighted environments. Lastly, the present disclosure contemplates a fully functional basketball system that is adaptable to varying user skill levels.

23 Claims, 18 Drawing Sheets

RETURN MACHINE FOR SPHERICAL GAMEBALLS AND TRANSPORT APPARATUS INCORPORATING THE SAME

BACKGROUND

The game of basketball is a game that is played and practiced in numerous locations throughout the world. The long standing worldwide nature of the sport is evidenced by the adoption of basketball as an Olympic sport in the 1930's. The game can be practiced or played by individuals or by individuals organized, formally or informally, into teams. Across the globe, a multitude of both professional and non-professional basketball teams and leagues exist. When being practiced or played by individuals, or in teams, the game of basketball can offer a means of recreation, personal challenge and entertainment for participants. As a spectator sport, the game is a source of entertainment for people in a myriad of venues across the globe, e.g. gymnasiums, public streets, private driveways, recreational facilities, college or professional sports venues, etc. The game can be practiced, played or enjoyed almost anywhere. For those who practice at refining their basketball skills, such as improving shooting techniques, or executing basketball plays, alone or in groups, an inordinate amount of time and energy can be expended on an activity wholly unrelated to improving player skill. The unfruitful, time consuming activity is the collection and return of basketballs to players at desired positions on the playing court or surface. This non-productive activity can waste significant player time and energy and substantially impairs the rate at which those desiring to become more proficient at the game improve.

Prior U.S. Pat. No. 6,241,628, that issued on Jun. 5, 2001, to present inventor Jenkins, et al. discloses a collapsible collecting net and ball projecting mechanism that is utilized to collect basketballs and return them to users of the device. The device provides a means for collecting and delivering basketballs to players. While the disclosed device was a measured advancement in the art, additional problems in the art remained.

Some of the problems that remained unresolved in the art included: the effective management of ball collection and return, an effective means of collecting and managing user information, providing users of such devices with useful feedback information, keeping users entertained, and enabling such devices to be utilized in a host of lighting environments. It is the goal of the present disclosure to solve these and other problems.

SUMMARY

The present disclosure contemplates a transportable apparatus for use with spherical game balls including a target, a collection and delivery assembly adapted to be positioned near the target to receive game balls shot toward the target and project the game ball toward a least one location on a playing surface and a transport device supporting the target and collections and delivery assembly to permit transport of the apparatus on the playing surface. It is contemplated that the transportable apparatus is manually transportable along the playing surface. The transport device may include at least one wheel base platform to permit rolling transport of the apparatus along the playing surface. Transport device may also include a pair of base platforms, a first one of the platforms supporting the target and a second one of the platforms supporting the collection and delivery assembly. It is contemplated that the base platforms are removably attachable to one another. Further, each of the base platforms may include a plurality of wheels to permit rolling transport of the apparatus along the playing surface. It is contemplated that a handle may be associated with at least one wheeled base platform to facilitate manual transport of set apparatus along the playing surface. The present disclosure also contemplates a basketball return machine that includes a basketball collector positionable beneath a basketball goal to receive basketballs shot toward the basketball goal, a projecting device positioned to receive basketballs from the collector and deliver them toward at least one delivery location alone a playing surface, thereby enabling practice shots from such location without requiring a shooter to retrieve shot basketballs, a escapement positioned beneath basketball collector for dispensing received basketballs into the projecting device, and a yoke coupling a lower end of the basketball collector to the escapement to permit the received basketballs to be fed into the escapement. It is contemplated that the escapement is operative to accommodate basketballs retrieved by the basketball collector by retaining at least one of the basketballs in a waiting state while another of the basketballs is supported by the projecting device in a ready state prior to delivery toward the delivery location. The escapement may also be suspended from the yoke. The basketball collector may also include a netted framework which spans beneath the basketball goal and tapers downwardly toward the escapement, and including downwardly slopped shoot interfaced between netted framework and the escapement for funneling received basketballs into the escapement. The basketball collector may also include a netted framework which spans beneath the basketball goal and tapers downwardly toward the escapement, the netted framework including the upper portion having rectangular geometry, and a portion having an upside down truncated pyramidal geometry. The escapement may be constructed as a cylindrical shell having an interior channel through which the collected basketballs are received, the escapement including a plurality of armatures operative to engagedly retain basketballs within the escapement. There may be a set of upper armatures and a set of lower armatures electromechanically coupled to one another such that a plurality of set basketballs can be retained within the escapement, each in a respective waiting state, prior to being dropped into the projecting device. Furthermore the upper and lower sets of armatures are operative to move from a basketball engaged position, to retain an associated upper and lower basketball in a waiting state, to a basketball disengaged state to permit the associated upper and lower basketball to move downwardly towards said projecting device. The return machine is adapted to move from a collapsed configuration to facilitate transport along the playing surface, to an expanded configuration for use. Furthermore, the collector may include a netted framework spanning beneath the basketball goal, the netted framework adapted to move from a folded state when the return machine is in the collapsed configuration, to one of a plurality of deployed states. When the return machine is in expanded configuration, and wherein basketball goal is selectively adjustable in height. Lastly, each of the netted framework and the basketball goal is adapted to be selectively adjustable in height between discreet deployment positions to accommodate different player skills.

DETAILED DESCRIPTION

Figure 1:
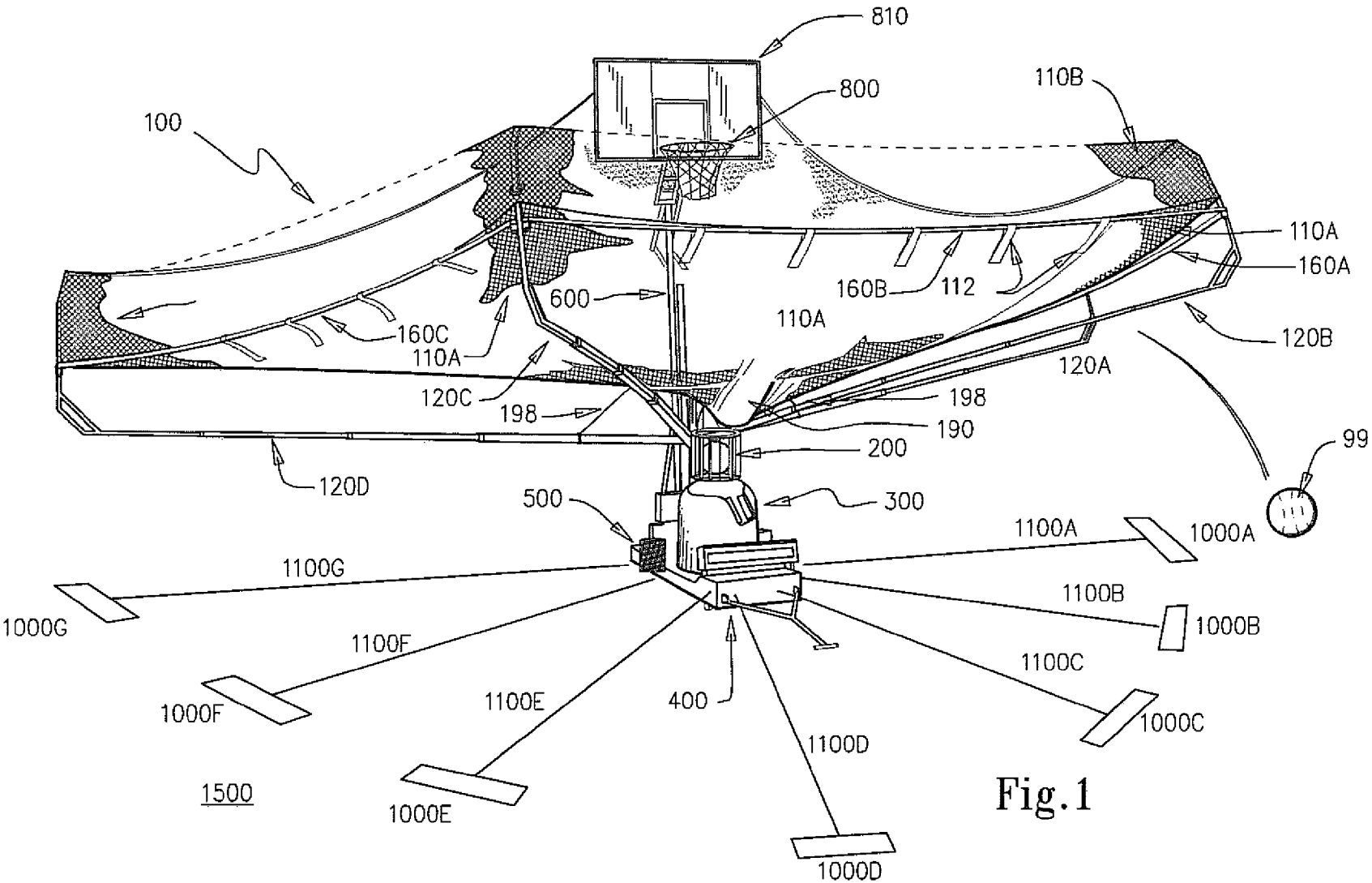
FIG. 1 is a perspective view of a ball return machine and goal unit.

The present disclosure generally relates to a basketball return machine which may be utilized with either a goal unit or a stand-alone basketball goal. Either or both of the basketball return machine and goal unit may be fixed in location or adapted to be portable. The basketball return machine is utilized to collect basketballs that are shot in the direction of a basketball goal and return them to the users of the system at one or more locations around the return machine's perimeter. The present disclosure eliminates the need for persons or other means being deployed to capture and return balls to persons practicing or playing a game of basketball. The present disclosure can function to hone the skills of persons wishing to enhance their basketball game skills (i.e. being the basketball equivalent of a batting cage), provide entertainment for persons related to the placement of balls through a basketball hoop, or both. Features of the present disclosure may be adapted to indicate ball delivery direction and location. The present disclosure may provide players with visual or audio feedback or both. Furthermore, the video and audio features of the present disclosure may be interactive. The video and audio record and playback capabilities may be adapted to permit users to evaluate their performance in making basketball shots, provide users with shot or game feedback, or simply entertain. The present disclosure contemplates features that permit its use in low level light or even unlighted environments. Lastly, the present disclosure contemplates a fully functional basketball system that it is adaptable to varying user sizes, e.g. adult, junior and peewee, and may easily be transported, assembled and disassembled at various locations.

In describing the preferred embodiments of the present disclosure as illustrated in the drawings, specific terminology will be resorted to for the sake of clarity. However, the disclosure is not intended to be limited to the specific embodiment illustrated and terms selected; it being understood that each specific term includes all technical equivalents which operate in a similar manner to accomplish a similar purpose.

The broad features of the present disclosure may be understood with reference to FIG. 1. FIG. 1 shows a basketball collector 100, a escapement 200 and a projecting device 300, which delivers basketballs toward at least one delivery location 1000 on the playing surface 1500, positioned beneath a basketball goal 800 that is supported by a backboard 810. As depicted, base platform 400 supports the projecting device 300, the escapement 200 and the basketball collector 100. Visible elements of the basketball collector 100 are the extension arms 120A-D supporting the netted framework 110A-B. Also depicted is a rearward second base platform 500 supporting a goal post 600, backboard 810 and basketball goal 800.

Figure 2:
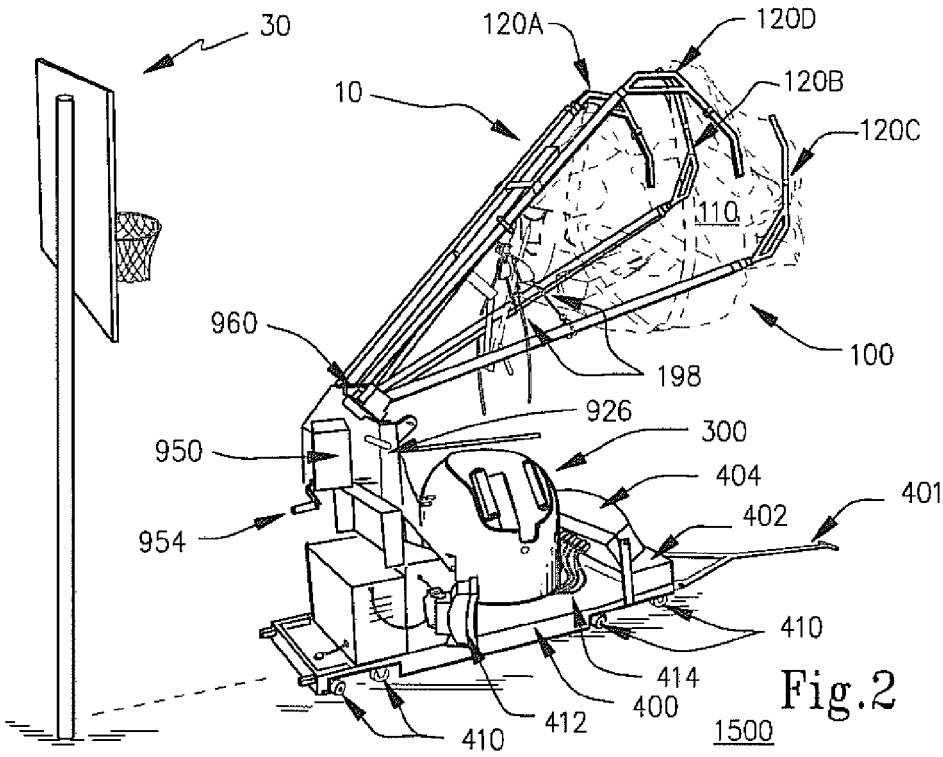
FIG. 2 is a perspective view of a ball return machine and stand-alone basketball goal.

A first exemplary embodiment of the present disclosure is the basketball return machine 10 shown in FIG. 2. The basketball return machine 10 has a use state, wherein it is configured to permit persons to shoot basketballs toward a goal, collect those basketballs and return them to a person at one or more locations on a playing surface, and a storage state, wherein it has a reduced profile. FIG. 2 depicts a basketball return machine 10 with a collector 100 in a folded state. Broadly speaking, the basketball return machine 10 comprises a first base platform 400 supporting a collector 100, a projecting device 300, a escapement 200 and a yoke 930. The escapement 200 and yoke 930 are not shown in FIG. 2 for the sake of clarity, but may be seen with reference to FIG. 7. As shown in FIG. 2, the basketball return machine 10 is utilized on a playing surface 1500 in conjunction with a stand-alone basketball goal 30. The basketball return machine 10 may be supported on a playing surface 1500 and may include a mechanism permitting it to be movable, such as wheels 410 and a handle 401. In the alternative, the basketball return machine 10 may be non-movable or set in a fixed location. Further, the basketball return machine may include a display 404 and one or more speakers 412.

Figure 3A:
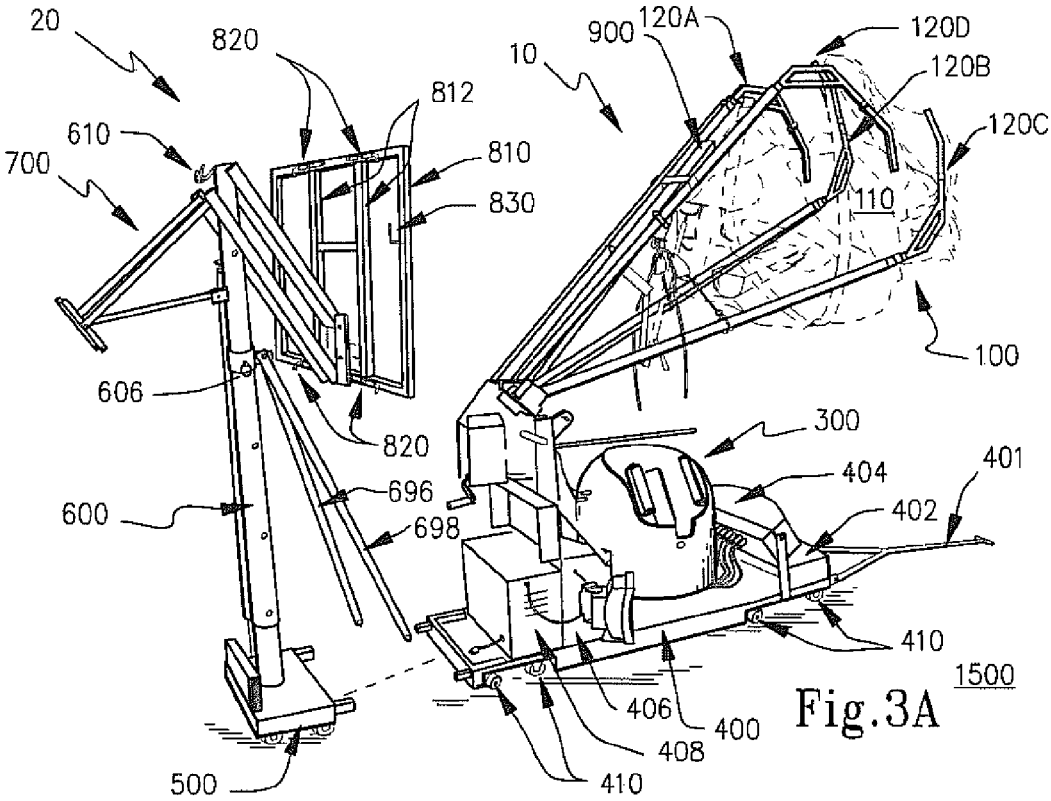
FIG. 3A is a perspective view of a separate ball return machine and separate goal unit.
Figure 3B:
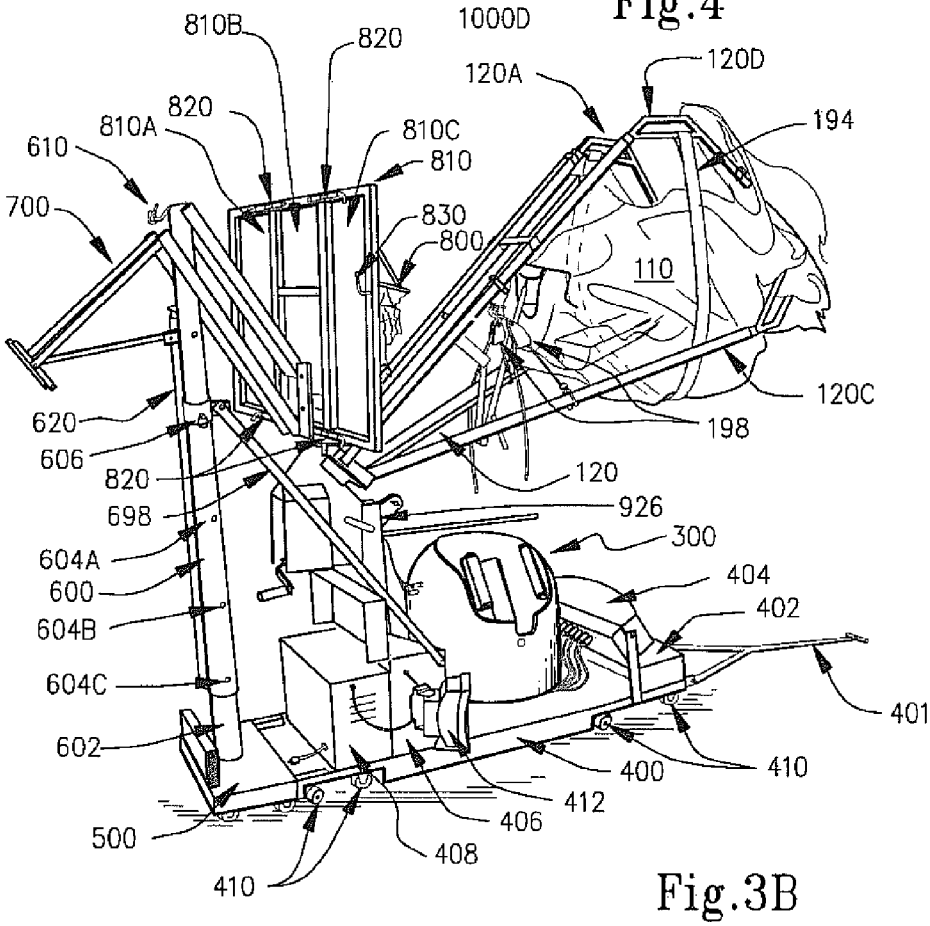
FIG. 3B is a perspective view of a ball return machine interfacing with a goal unit.

FIGS. 3A and 3B, in addition to FIG. 1, show a second exemplary embodiment of the present disclosure wherein the basketball return machine 10 is provided with a goal unit 20. Similar to the basketball return machine 10, goal unit 20 has a use state, wherein goal unit 20 is configured for a person to shoot basketballs toward a goal at a selected height, and a storage state, wherein the goal unit has a reduced profile. As is shown in the progression from FIG. 3A to FIG. 3B, the goal unit 20 may be coupled with the basketball return machine 10 by bringing the base platforms 500 and 400 in close proximity to one another. The base platforms may be simply positioned in spatial proximity to one another or, as depicted in FIGS. 3A and 3B, connected together at connection points, including but not limited to connections at the base platforms 400 and 500 and via a first goal post strut 696 and second goal post strut 698 to a location on the basketball return machine 10. Again, in FIGS. 3A and 3B, the basketball return machine 10 is shown with the collector 100 in the folded state. The goal unit 20 is shown which broadly comprises a second base platform 500 supporting a goal post 600, a backboard 810, and goal 800. As shown in FIGS. 3A and 3B, a goal post 600 is shown in a lowered state and a backboard lift mechanism 700 is shown in a lowered state. Further, a backboard 810 is shown in a deployed state. As is evident from FIGS. 2 and 3, the goal unit 20 and basketball return machine 10 may assume one or more states having a minimized structure. And as is evident from FIG. 1, the goal unit 20 and basketball return machine 10 may also assume states wherein various parts of their structure are enlarged. What is also evident from FIGS. 2 and 3 is that the basketball return machine 10 and goal unit 20 may be configured to be portable, such as having wheels for 10, or may be non-movable or in a fixed location.

The features of the present disclosure may be broadly understood with reference to FIG. 1. A ball collector 100 is positioned beneath a basketball goal 800 and receives basketballs shot toward goal 800. The basketball collector 100 has a netted framework 110 that spans beneath a basketball goal 800 and tapers downwardly toward a escapement 200. The netted framework 110 has an upper portion 110B having a rectangular geometry and a lower portion 110A generally having an upside-down, truncated pyramidal geometry. The collector 100 may assume a folded state wherein the netted framework 110 is in a collapsed configuration, as in FIG. 2, or a deployed state wherein netted framework 110 is in an expanded configuration, as in FIG. 1. The netted framework 110 of the basketball collector 100 is supported by one or more extension arms 120 and may have a plurality of extension arms 120. Each extension arm 120 is formed as a subassembly and may be adapted to move from a retracted to an extended state as the netted framework 110 moves from a folded to a deployed state. Equally, it can be appreciated that the extension arms may also be adapted to move from an extended to a retracted state as the netted framework 110 moves from a deployed state to a folded state. The construction of the extension arms 120 may allow them to vary in length, allowing the basketball collector 100 to assume a plurality of deployed states consistent with the needs of variously skilled and sized users, e.g. adult, junior, or peewee. The escapement 200 is positioned beneath the basketball collector 100 and is operative to accommodate basketballs received by the basketball collector 100 by retaining at least one in a waiting state. The escapement supports basketballs and dispenses basketballs into the projecting device 300. The projecting device 300 receives basketballs from the escapement 200 and maintains basketballs in a ready state. The projecting device 300 may deliver basketballs toward at least one delivery location 1000 on the playing surface 1500. The first base platform 400 supports the projecting device 300, the escapement 200 and the basketball collector 100 as shown. A second base platform 500 supports the goal post 600, backboard 810 and goal 800.

Figure 4:
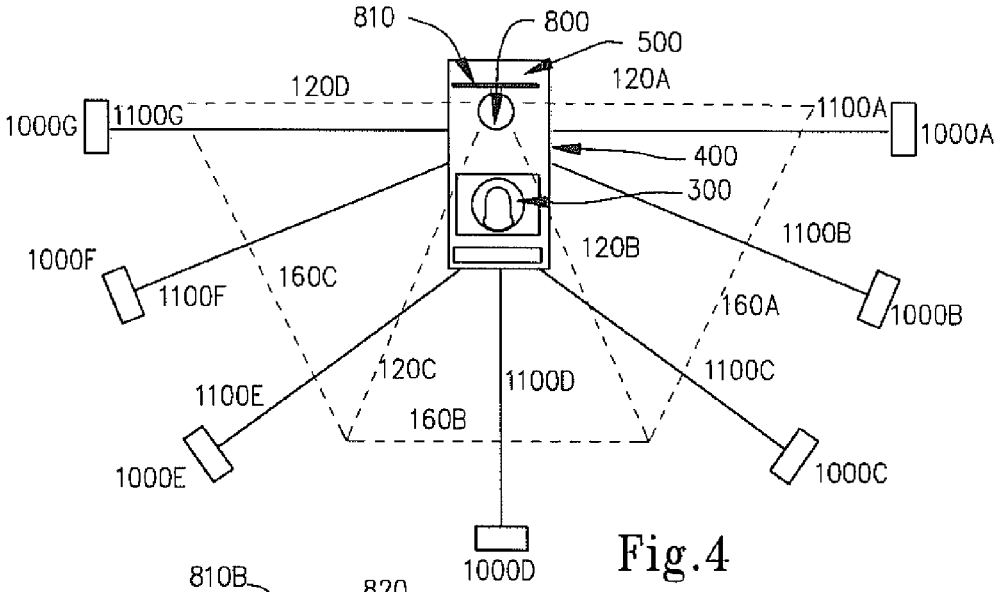
FIG. 4 is a top view of a ball return machine and goal unit.

It may be helpful to understand, in a broad sense, how the present disclosure can operate and be utilized. FIG. 4 shows a top view of the second exemplary embodiment of the present disclosure supported on a playing surface 1500. The first base platform 400, second base platform 500, goal 800 and basketball backboard 810 are depicted. In phantom are depicted extension arms 120A-D and stabilizers 160A-C. Also shown are delivery direction indicators 1100A-G and delivery locations 1000A-G. The drawing shows how the ball return machine 10 can be utilized to direct balls to one or more locations on a playing surface 1500, including but not limited to discreet delivery locations 1000A-G. Thus, the basketball return machine 10 can be configured to deliver basketballs to a multitude of locations on a playing surface 1500. Further, the basketball return machine 10 can be configured so that a person standing at a delivery location, 1000A-G, can shoot a basketball towards a goal 800 and have a basketball returned to them by the basketball return machine 10 at their current location or, depending on basketball return machine 10 configuration, at any other location on the playing surface 1500. In FIG. 4, it can also be appreciated that a ball can be delivered to a user at and around the periphery of the ball return machine 10 from the projecting device 300 along a multitude of horizontal plane projections, with varying vertical plane trajectories. As can be appreciated from FIG. 4, the basketball return machine 10 could function in conjunction with the goal unit 20 or, in its absence, with a stand-alone basketball goal 30. In either case, the basketball return machine 10 would enable basketballs shot towards a goal 800 to be collected and delivered to a player at one or more locations around the perimeter of a basketball goal.

Figure 31:
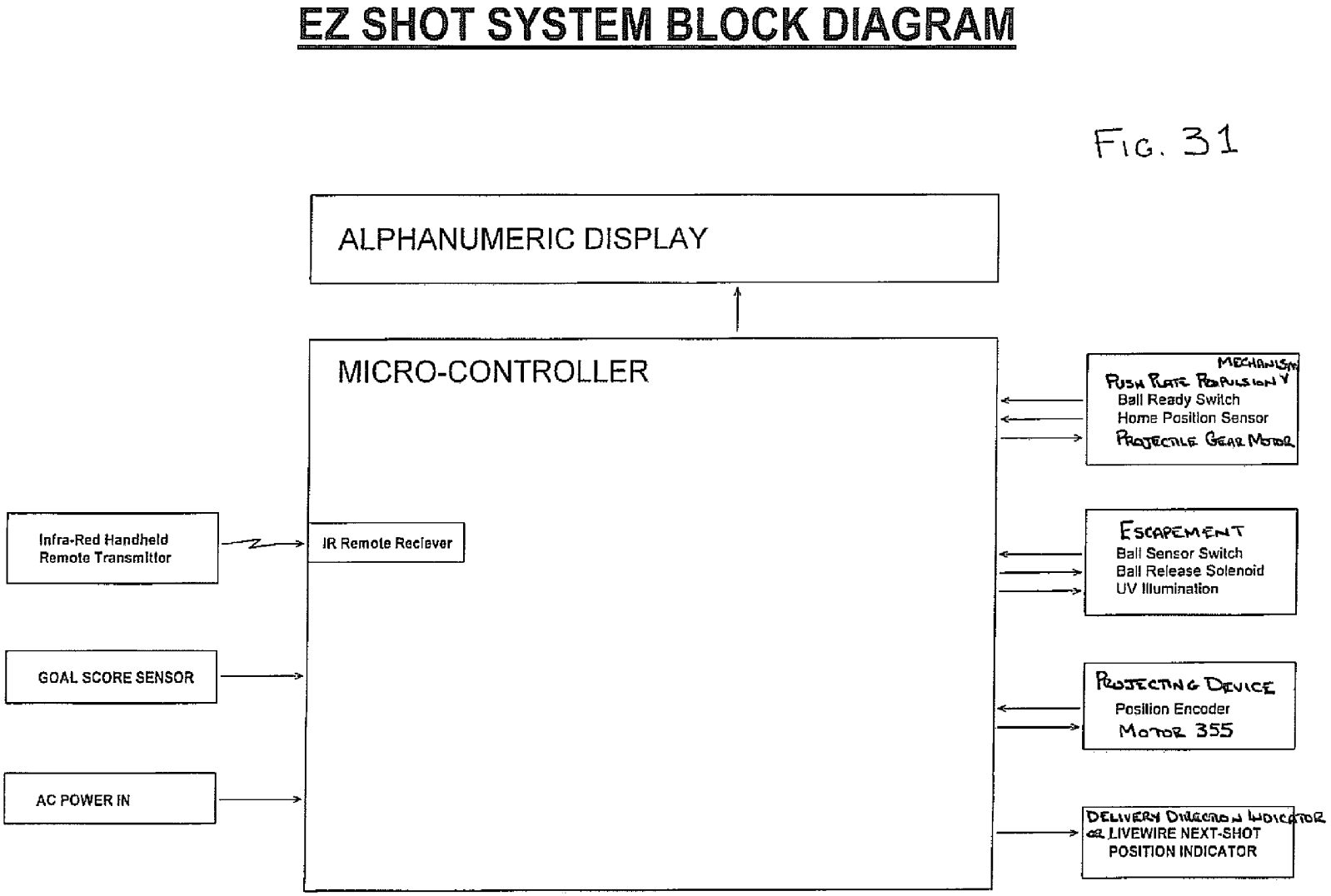
FIG. 31 is a schematic illustration of a microcontroller.
Figure 32:
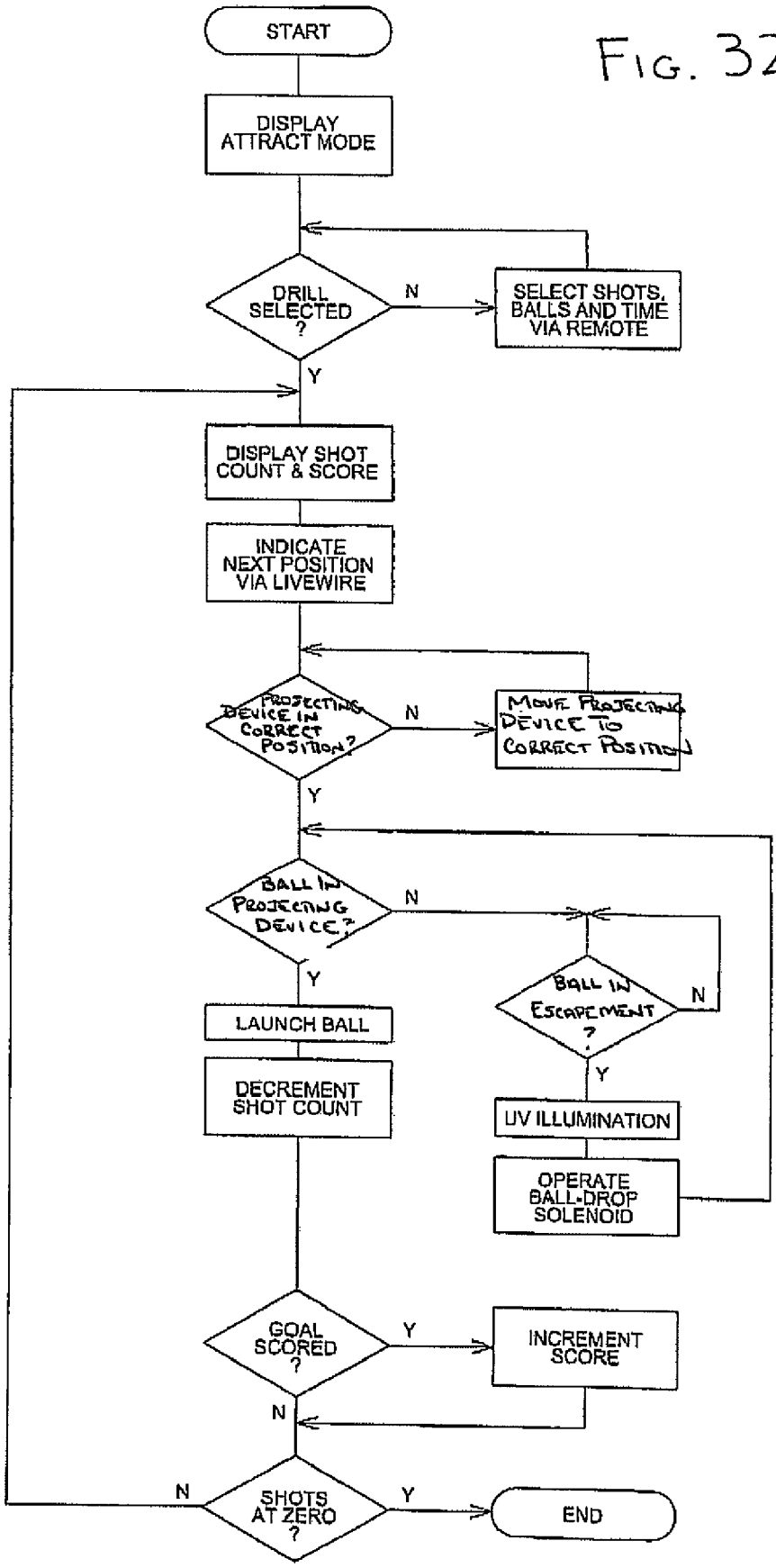
FIG. 32 is a schematic illustration of a software program.

The basketball return machine 10 can have a control system that uses a microcontroller to control and coordinate all elements of the machine operation. The microcontroller may be housed in the display 404, being powered, or be supported elsewhere on the first base platform 400. The elements of the basketball return machine 10 under microcontroller control may include the following: display 404/alphanumeric display, push plate 376 propulsion mechanism, escapement 200, projecting device 300, delivery direction indicator 1100, handheld remote control, goal score sensor 872, see FIG. 31. FIG. 32 is a software flow chart that depicts the logic employed by the microcontroller. Furthermore, the basketball return machine 10 operates from 120 VAC 60 Hz and requires a maximum of 15 Amps.

Figure 5A:
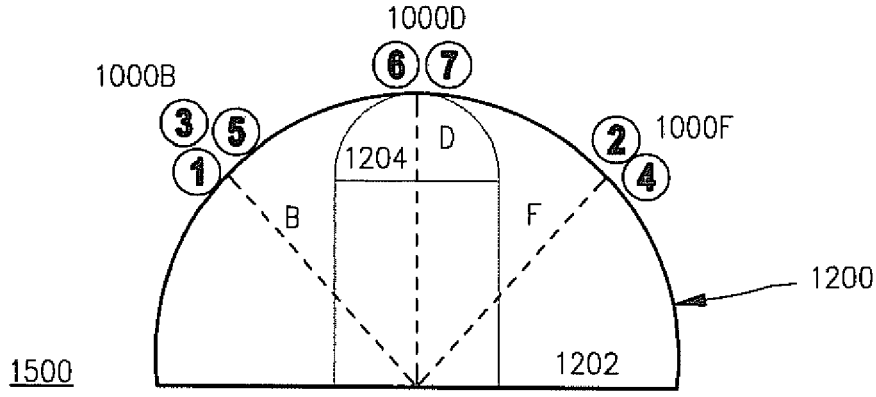
FIG. 5A-C are schematic illustrations of the sequence of basketball delivery by a basketball return machine to locations about its' periphery.
Figure 5B:
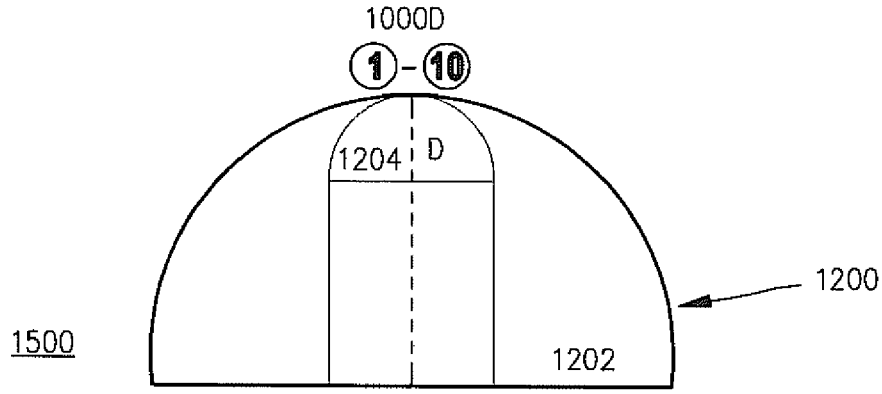
Figure 5C:
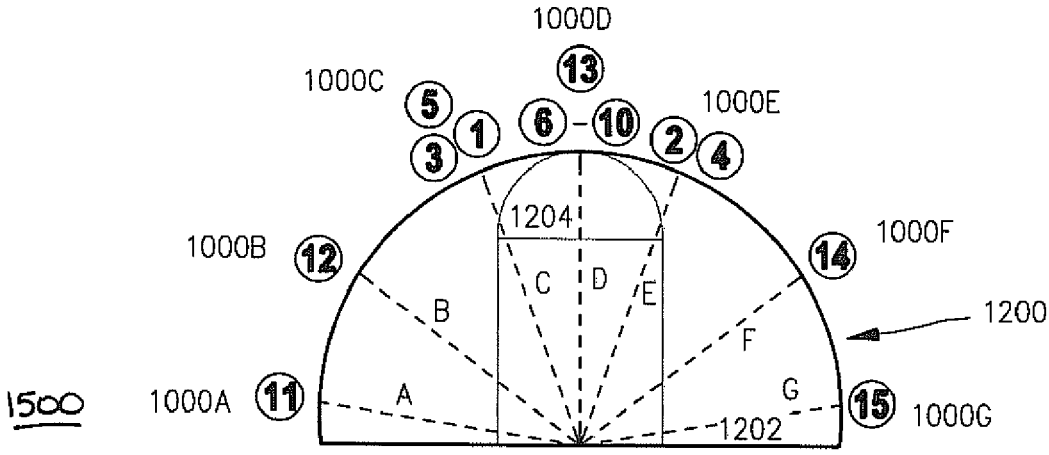

Turning to FIG. 5A-C, what is shown are schematics of a basketball three-point line 1200, base line 1202, free throw line 1204 and a playing surface 1500. What is depicted in FIGS. 5A-C is how the basketball return machine 10 can be configured to deliver basketballs to a varying sequence of locations, numbered 1-7, 1-10, and 1-15, respectively in the Figures, on the playing surface 1500. FIG. 5A shows how the basketball return machine 10 can be configured to deliver a series of basketballs, numbered 1 through 7, from the projecting device 300 to an ordered sequence of locations around the basketball delivery machine 10, i.e. 1000B, 1000D, and 1000F, including but not limited to the three point line 1200. FIG. 5B shows how the basketball return machine 10 can be configured to deliver a series of basketballs, numbered 1 through 10, from the projecting device 300 to a single location around the basketball delivery machine 10, i.e. 1000D. Lastly, FIG. 5C shows how the basketball return machine 10 can be configured to deliver a series of basketballs, numbered 1 through 15, from the projecting device 300 to a random sequence of locations around the basketball delivery machine 10, i.e. 1000A-G. It is contemplated that the basketball return machine 10 can be programmed to deliver a series of basketballs 1-25, 1-50, or more, from the projecting device 300 to an ordered sequence of basketballs to delivery locations around the periphery of the basketball return machine 10. It can be appreciated that the basketball return machine 10 can be configured so that: a) the order in which balls are delivered to various locations is ordered, random or some combination thereof; b) the number of balls delivered can vary; c) there can be one or more delivery location; and d) the distance balls are delivered from the ball return machine 10 can vary.

Taken together, FIGS. 1-5 and 7 suggest how a person could utilize the present disclosure to shoot basketball shots from various locations around the perimeter of a basketball goal and have those basketballs returned, in an ordered or random sequence, to one or more locations around the goal. In use, a person utilizing the ball delivery machine 10, either in conjunction with goal unit 20 or a stand-alone basketball goal 30, may shoot balls towards a goal, or towards the vicinity of a goal, and, whether they pass through the goal or not, have those balls collected by the basketball collector 100 when the collector 100 is in deployed state. The basketball collector 100, when in a deployed state, funnels collected balls towards the escapement 200, which supports and may maintain at least one basketball in a waiting state. Equally, it is contemplated that when a single basketball is utilized with basketball return machine 10, it may be held in either the escapement 200, in waiting state, or projecting device 300, in a ready state. The escapement 200 dispenses received balls to the projecting device 300, where they are maintained in a ready state prior to delivery toward a delivery location. Balls may then be delivered from the projecting device 300 to various locations around the periphery of the ball return machine 10, including but not limited to delivery locations 1000A-G. As stated above, it can be imagined that location, sequence, and number of delivered balls may all be varied.

Overall, the basketball return machine 10 of the present disclosure, in conjunction with a goal unit 20 or stand-alone basketball goal 30, can be utilized to return basketballs to a person shooting basketballs towards a goal. It can be appreciated how a person could utilize the present disclosure to practice and hone their basketball shooting skills. Further, in light of the present disclosure, it becomes evident how the present disclosure would enable a person to be much more efficiently practice shooting basketballs towards a goal.

Having a broad understanding of how the present disclosure works, specifically in light of how the basketball return machine 10 works, in conjunction with a goal unit 20 or a stand-alone basketball goal 30, to allow a person to shoot basketballs towards a basketball goal and, ultimately, have one or more balls returned to them at locations around the perimeter of the goal, a closer look at the construction of the components of the present disclosure is in order.

Figure 6:
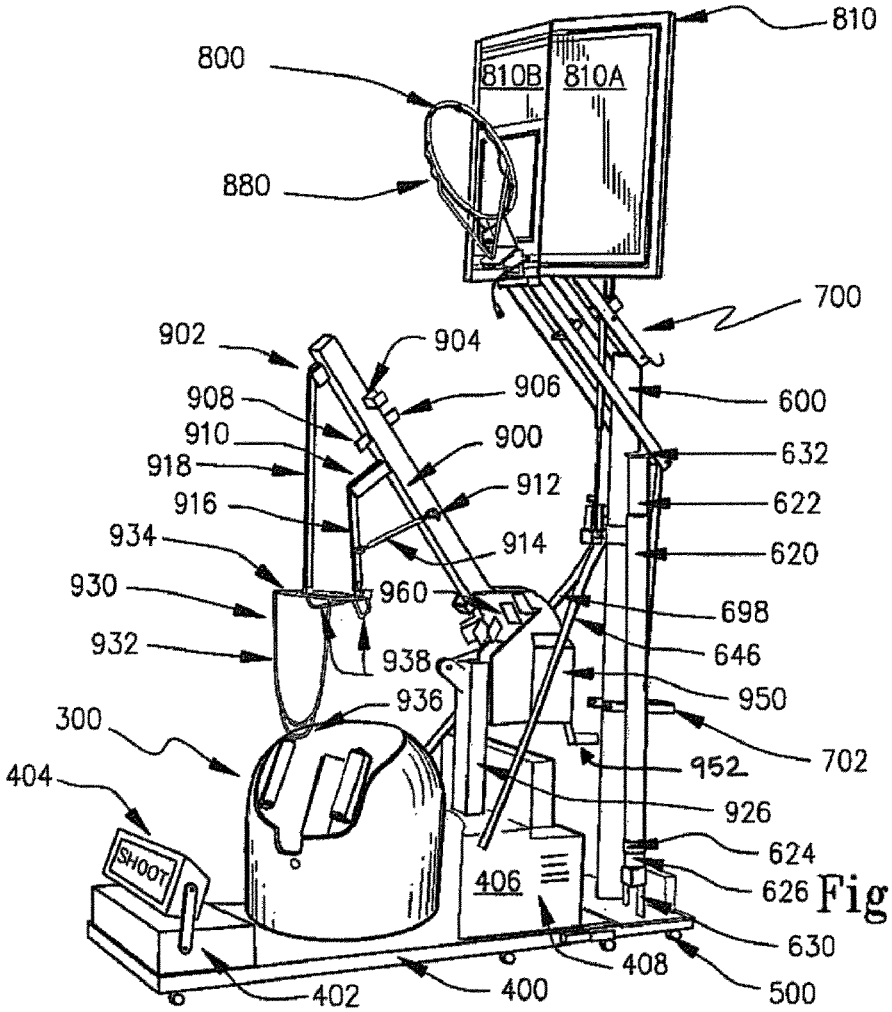
FIG. 6 is a perspective view of some components of a ball return machine and some components of a goal unit.

As seen in FIGS. 2 and 6, the basketball return machine 10 has a first base platform 400. The first base platform may be non-movable, i.e. fixed in location, or portable. As shown, the first base platform has wheels 410, although it can be appreciated that a number of other means could be provided for making the first base platform portable, such as rollers, tracks, etc. In order to facilitate movement, the first base platform could be provided with a transportation interface such as a handle 401. A number of other means could be provided for enhancing the portability of the basketball return machine 10, including but not limited to a trailer hitch mount. The first base platform 400 may have a first delivery direction indicator housing 402 in which delivery direction indicator 1100C-E may be enclosed, as seen in more detail in FIG. 17. Furthermore, a first base platform 400 may be provided with a display 404 by which means visual information may be communicated to persons utilizing the basketball return machine 10, also seen in more detail in FIG. 17. As can be imagined, numerous types of information may be relayed by the display 404 including shooting information, numbers of shots taken, next shot position, video images, score, percentage of shots made, and the like. The display 404 may be illuminated so as to be visible in darkened environment. Furthermore, the display may 404 also be adapted to provide video playback feedback. The display 404 may be a simple display, LCD screen, television screen, high-definition display, or flat-screen monitor. The display 404 could vary in size and configuration relative to the first base platform 400 and other components supported thereby. FIG. 6, in addition to FIG. 18, also shows how the first base platform 400 may support a second delivery direction indicator housing 406 within which delivery direction indicator 1100A, B, F, G may be enclosed and from which delivery direction indicator 1100 may be extended. Within second delivery direction indicator housing 406 may be stored, including but not limited to: audio playback or recording equipment, video playback or recording equipment, battery packs for powering various devices including the basketball return machine 10, tools, extra light rope, and the like. Furthermore, the first base platform 400 is shown in FIG. 2 as supporting a speaker 412 but could also support a number of other enhancements, including but not limited to: video recording and playback equipment, audio recording and playback equipment, a video camera, and photographic equipment.

Figure 17:
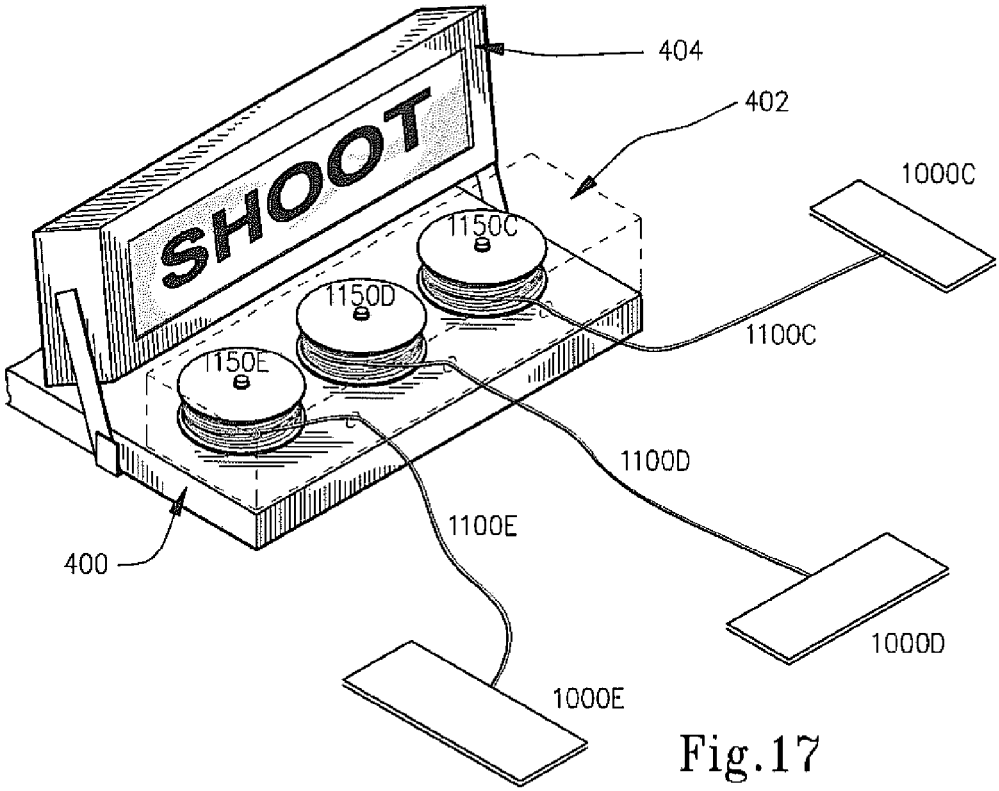
FIG. 17 is a perspective partial view of first base platform supporting a display and first delivery direction indicator housing.
Figure 18:
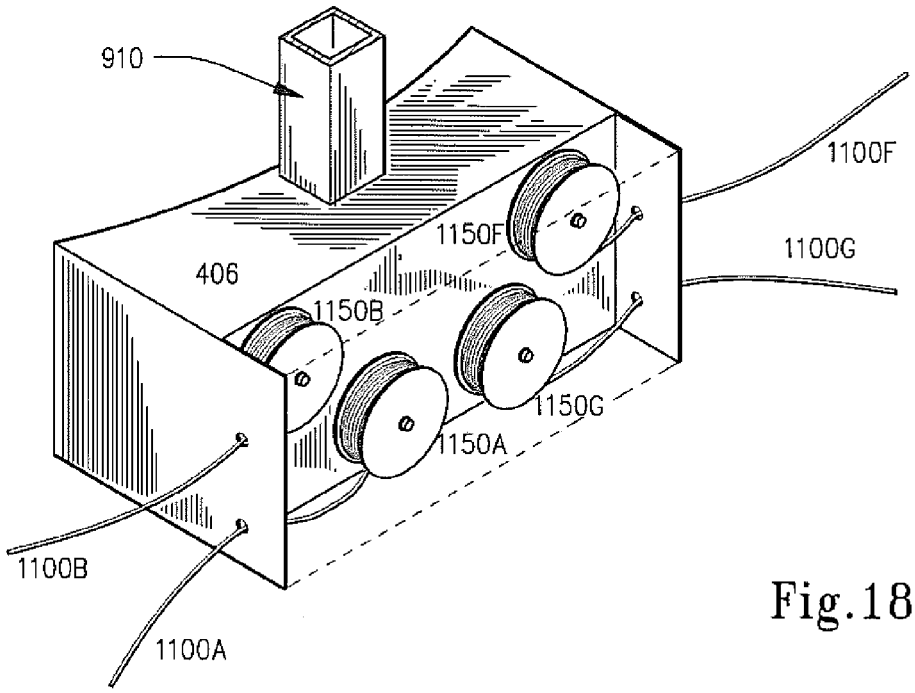
FIG. 18 is a perspective view of an isolated second delivery direction indicator housing.

FIG. 17 shows first base platform 400 supporting first delivery direction indicator housing 402 which contains spools 1150C-E whereupon delivery direction indicator 1100C-E is spooled. The delivery direction indicator 1100C-E may be fed from or stored upon each spool 1150C-E, respectively. Furthermore, it is shown that delivery direction indicator 1100C-E may be fed out of first delivery direction indicator housing 402. Each delivery direction indicator 1100C-E leads to delivery locations 1000C-E. Thus, when FIG. 17 is viewed in conjunction with FIG. 1, it becomes apparent how delivery direction indicator 1100C-E is stored and located on first base platform 400. FIG. 18 shows a cut-out interior of the second delivery direction indicator housing 406. Within the second delivery direction indicator housing 406 are spools 1150A-B, F-G whereupon delivery direction indicator 1100 A-B, F-G is spooled. The delivery direction indicator 1100 A-B, F-G may be fed from or stored upon each spool 1150 A-B, F-G, respectively. Furthermore, it is shown that delivery direction indicator 1100 A-B, F-G may be fed out of second delivery direction indicator housing 406. Each delivery direction indicator 1100 A-B, F-G leads to delivery locations 1000 A-B, F-G. Thus, when FIG. 18 is viewed in conjunction with FIG. 1, it becomes apparent how delivery direction indicator 1100 A-B, F-G is stored and located on first base platform 400. Delivery locations 1000A-G may be connected or separate from delivery direction indicator 1100A-G. Furthermore, delivery locations 1000A-G can be stored at a location at the base of second base platform 500.

First base platform 400 is provided with electrical power, for running its various powered components, which may be provided from an external source, such as a power from a wall plug, generator, or external battery, or self-contained source such as a battery or power supplied from another part of the basketball return machine 10 or, optionally, the goal unit 20.

Display 404 may contain an alphanumeric display panel; an infra-red or RF remote-control receiver; the 90V DC motor controller; the microcontroller system (Printed Circuit Board Assembly (PCB); the system power supplies and the electrical connectors necessary to interconnect with the external system components. The alphanumeric display panel is comprised of a large array of discrete ultra-bright LED devices which are driven by the microcontroller system to provide visual communication and interaction with the users of the machine. The remote-control receiver allows the input of data to the system to facilitate selection of the operating parameters (the "drills") for a given training session. The 90V motor controller translates the logic-level control signals from the microcontroller to the voltages and currents necessary for the bi-directional control of the motor. The microcontroller PCB includes the microcontroller chip and its associated logic. It also includes the Livewire, or illuminated delivery direction indicator 1100 drivers. The system power supplies provide the necessary voltages and currents to operate the logic, sensor and display components.

An integral part of the microcontroller system may be a hand-held remote control module. This unit communicates with the display 404 via infra-red radiation modulated with appropriate control codes. Pushbuttons on the hand-held remote control module allow the operator to interact with a series of menu-driven selections sequentially presented on the alphanumeric display. These menu selections include the selection of the "drill" to be executed; the number of balls launched for each step of the drill, and the time interval between the ball launches. The drill selected specifies the number of shots in the drill. Also, each unique drill is preprogrammed with a patterned sequence of aiming spots to which the ball is launched. These sequences are designed to elicit specific patterns of movement by the player as the player is required to move from one aiming spot to the next in a pre-determined time period. An exception to the pre-programmed spot sequence is provided in the "manual" mode in which the operator can specify the location, interval, and number of shots for a customized workout drill.

Display 404 may be outfitted with an alphanumeric display that allows selection of various parameters of the ball return machine 10 machine sequence prior to the execution of an actual drill. After a selected drill has been initiated, the alphanumeric display indicates the progress of the drill. The shots remaining in the drill sequence are displayed, as well as the count of successfully made baskets (goals.) Upon initial power-up of the machine the alphanumeric display may presents an "attract mode" consisting of the alternating messages. After a drill has been selected the display performs as described above.

Figure 7:
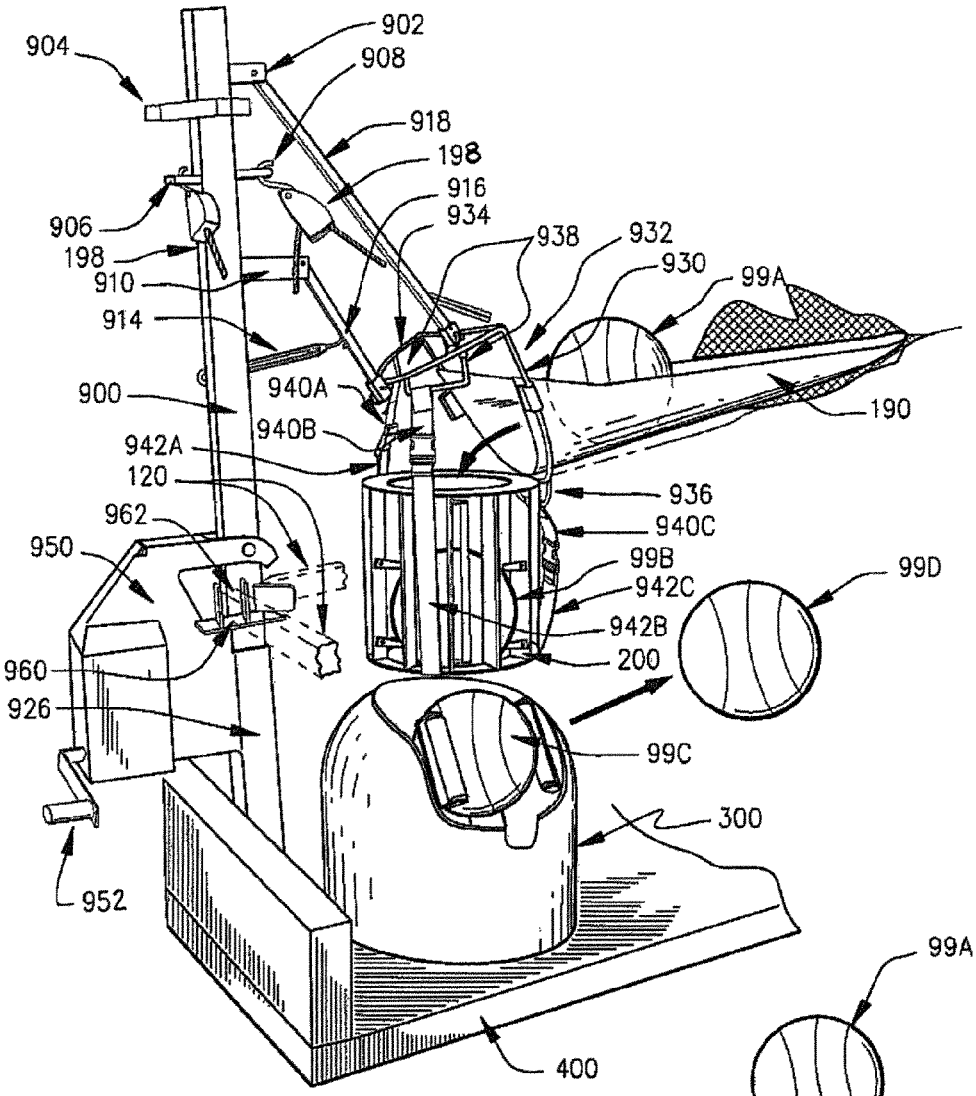
FIG. 7 is a perspective view of some components of a ball return machine.
Figure 19:
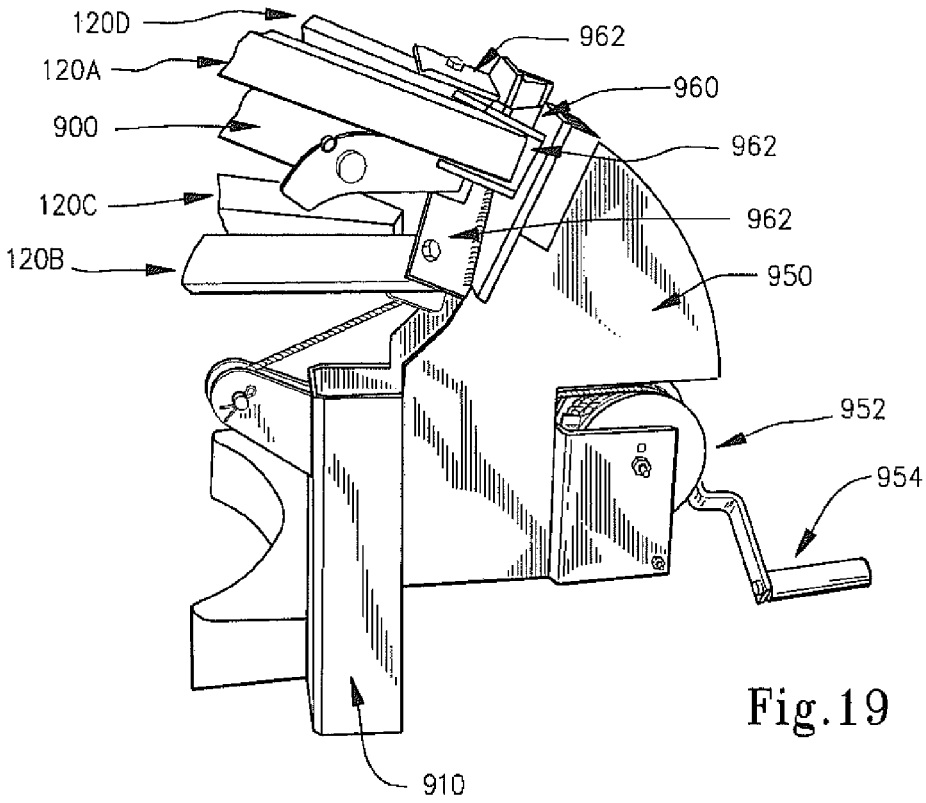
FIG. 19 is a perspective view of the mast-support post interface region.

FIG. 6 shows support post 926 emanating from first base platform 400. Support post 926 supports the mast support post interface 950 which supports mast 900. FIG. 6 has some of the basketball collector 100 and basketball return machine 10 elements removed for the sake of clarity. Mast 900 is shown in a configuration that comports with the basketball collector 100 being in a folded state, wherein, although it is not shown, the netted framework 110 is in a collapsed configuration. FIG. 7 depicts a simplified first base platform 400, which is shown for the sake of clarity, wherein the mast 900, yoke 930, escapement 200 and collector 100 are depicted wherein the collector 100 is in a deployed state, as shown in FIG. 1. Referring to FIGS. 6, 7 and 19, it can be seen that the mast support post interface 950 is provided with a mast movement element 952, as seen in FIG. 19, which may be a winch having a handle 954. Mast movement element 952, which may be a winch, interacts with pedestal 960 such that manipulation of the mast movement element 952 causes spatial displacement of the pedestal 960. Mast 900 is supported by pedestal 960 and moves in concert with it, thus movement of pedestal 960 causes movement of mast 900. Mast 900 must be raised, as shown in FIG. 7, in order for collector 100 to assume a deployed state and may be lowered, as shown in FIG. 6, in order for collector 100 to assume a folded state. The raised position of the mast 900 is utilized when the basketball return machine 10 is in use.

Pedestal 960 provides a connection and pivot point for extension arms 120 of the basketball collector 100, that being the pedestal extension arm interface 962. Pedestal 960 may have one or more pedestal extension arm interfaces 962 depending on the number of extension arms 120 that comprise the basketball collector 100 and the configuration of the pedestal 960. The pedestal extension arm interface 962 is clearly shown in FIG. 19. Like the mast 900, extension arms 120 are connected to the pedestal 960 at the pedestal extension arm interface 962 move in concert with the pedestal 960. Thus, movement of pedestal 960 causes movement of extension arms 120 attached to the pedestal 960. In order for the collector 100 to assume a deployed state, the pedestal 960 must be in an orientation where it permits the extension arms 120 to assume extended states, as shown in FIG. 7, that permit the netted framework 110 to assume a deployed state, the netted framework 110 being in an expanded configuration. Because the mast movement element 952 operates to move the pedestal 960, it can be appreciated that when the mast movement element 952 is utilized to move the pedestal 960, the mast 900 and the extension arms 120 all move in cooperation with the movement of the pedestal 960. In FIG. 7, the extension arms 120 are shown in phantom as in the deployed state, the extension arms being moveably attached at pedestal extension arm interfaces 962 of the pedestal 960. In FIG. 6, extension arms 120 are removed for the sake of clarity.

FIG. 7 shows that mast 900 supports a rear padeye 906 and front padeye 908 to which are attached rope ratchets 198 that support the extension arms 120 of the collector 100. The rope ratchets 198 may support and/or locate the extension arms 120 in space when the collector 100 is in the deployed state, with the extension arms 120 being in an extended state. Further, the rope ratchets 198 may utilized, when the collector 100 is in a folded state, to hold the extension arms 120 close to the mast 900, optionally housed in extension arm storage bracket 904. The way in which the lower portion of the rope ratchets 198 intersect with the extension arms 120 when the collector is in a deployed state is shown in FIG. 1. For the sake of clarity, only two rope ratchets 198 and two phantom extension arms 120 are shown in FIG. 7. However, what should be understood is that with regard to the embodiment shown in FIG. 1, two rope ratchets 198 emanating from a padeye 906 are used to attach to, locate and support two extension arms 120A & 120D, and two rope ratchets 198 emanating from a padeye 908 are used to attach to, locate and support extension arms 120B & 120C. When the ball collector 100 is in the deployed state, the rope ratchets located at the padeyes 906 and 908 are extended to drop the extension arms away from the mast 900. Equally, when the ball collector 100 is being converted from a deployed state to a folded state, the rope ratchets 198 may be used to pull up the extension arms 120 and bring them in close proximity to mast 900. When extension arms 120 are brought in close proximity to the mast 900, they can be placed for storage in the extension arm storage bracket 904. Extension arm storage bracket 904 in conjunction with the rope ratchets that emanate from padeyes 906 and 908 and attach to extension arms 120 help to locate and/or support the extension arms 120 when the basketball collector 100 is in the folded state.

FIGS. 6 and 7 also show how mast 900 also provides support for yoke 930. The mast 900 has an upper mast connection 902, which connects to the upper yoke support arm 918. The upper yoke support arm 918 supports yoke 930. Lower mast connection 910 is connected to the mast 900 and connects with the lower yoke support arm 916. The lower yoke support arm 916 also supports yoke 930. The upper yoke support arm 918 is moveably connected at its connection point with the upper mast connection 902. Equally, the lower yoke support arm 916 is moveably connected at its connection point with the lower mast connection 910. Also provided on mast 900 is a yoke adjustment turnbuckle padeye 912, as shown in FIG. 6. Interconnected from the yoke adjustment turnbuckle padeye 912 to the lower yoke support arm 916, the connection on lower yoke support arm 916 being a padeye, is yoke adjustment turnbuckle 914. Yoke adjustment turnbuckle 914 permits the distance that the yoke 930 is spatially oriented relative to the mast 900 to vary and be adjusted to provide optimal positioning of yoke 930 in space. Further, disconnecting the yoke adjustment turnbuckle 914 from either the mast 900 or lower yoke support arm 916, permits the yoke 930, along with the upper and lower yoke support arms, 916 and 918, respectively, to pivot towards the mast 900 so that the yoke 930, along with its mast 900 support apparatus, may assume a storage state. As shown in FIGS. 6 and 7, yoke 930 has a first yoke member 932 and second yoke member 934 and is provided with brackets 936 and 938. Emanating from each of brackets 938 are yoke strap 940, A and B, respectively. Emanating from bracket 936 are also yoke straps 940C. The yoke straps 940A-C provide a means for attaching escapement straps 942A-C to the yoke straps. The yoke straps 940A-C and escapement straps 942A-C provide a means for positioning the escapement 200 in an optimal location for basketball 99 handling relative to yoke 930. Furthermore, yoke adjustment turnbuckle 914, yoke straps 940A-C and escapement straps 942A-C, in conjunction with mast support post interface 950, mast 900, upper yoke support arm 918 and lower yoke support arm 916, permit the optimal spatial location of escapement 200 relative to projecting device 300. This permits basketballs 99 to optimally move from chute 190 of basketball collector 100 to escapement 200 to projecting device 300.

Referring to FIG. 7, it shows a cutout of collector 100 depicting how balls 99 shot toward a basketball goal are collected in collector 100 and exit collector 100 from chute 190 which is interfaced with yoke 930. As discussed, escapement 200 is adjustably interfaced with yoke 930. Thus, balls 99 collected in collector 100, see 99A, travel from collector 100 chute 190 to escapement 200, see 99B.

As seen in FIG. 7, which depicts the basketball return machine 10 in use, the spatial orientation of escapement 200 with respect to yoke 930 and chute 190 is adjustable so that there is efficient transfer of collected balls 99 from collecting device 100 to escapement 200, see 99A to 99B, more specifically chute 190 to escapement 200. Escapement 200 is oriented in space relative to projecting device 300, shown in FIGS. 7 and 9, so that the efficient transfer of balls 99 occurs from escapement 200 to projective device 300, shown in FIG. 7 99B to 99C. The spatial orientation of the escapement 200, yoke 930 and chute 190 can be adjusted by manipulating the size and/or spatial orientation of one or a combination of the basketball return machine 10 elements, including: base platform 400, pedestal 960, yoke adjustment turnbuckle 914, upper yoke support arm 918, lower yoke support arm 916, yoke straps 940, escapement straps 942, extension arms 120 and rope ratchets 198. By adjusting the size and spatial orientation of the basketball return machine 10 elements, the spatial orientation of the collector 100, including chute 190, yoke 930 and escapement 200 can be adjusted so that the transfer of balls 99 from collector to escapement, shown in FIG. 7 99A to 99B, and escapement 200 to projecting device 300, shown in FIG. 7 99B to 99C, is optimized when the basketball return machine 10 is in use. Furthermore, it is contemplated that the projecting device 300 may either have a fixed location or be spatially adjustable so as to permit the optimization of ball transfer from escapement 200 to projecting device 300, as shown in FIG. 7 99B to 99C.

Figure 10:
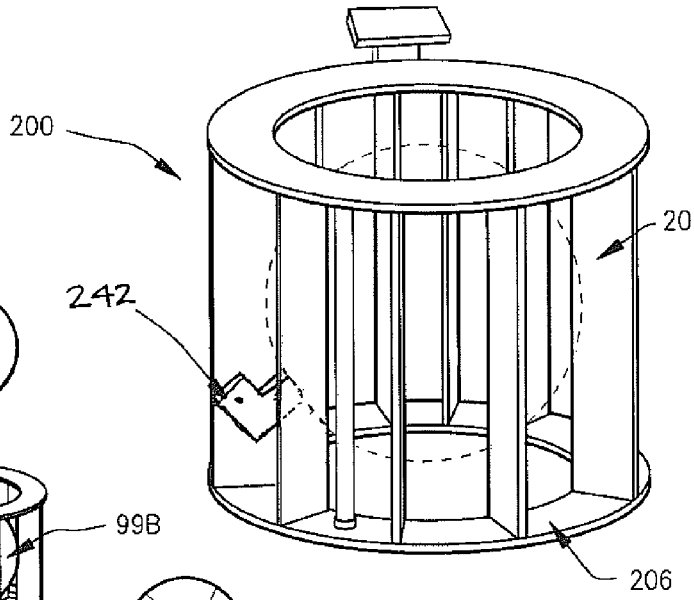
FIG. 10 is a perspective view of a escapement containing a phantom basketball.

FIG. 7 depicts the sequential process by which basketballs are collected by collecting device 100, transferred to escapement 200, thereafter received by projecting device 300 and thereafter delivered toward an appropriate delivery location by projecting device 300. This sequential movement of balls 99 is shown in FIG. 7 by the progression of balls 99 from 99A to 99D. It can be appreciated that while FIGS. 7, 9 and 10 depict only one basketball 99, it is contemplated that one or more basketballs 99 may be accommodated by the escapement 200, as depicted in FIG. 8, depending on the construction of the escapement 200.

Figure 8:
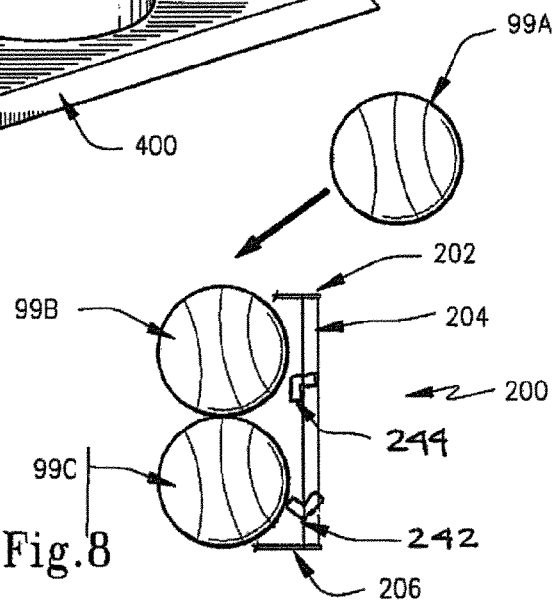
FIG. 8 is a segmented side view of a escapement and basketballs.
Figure 9:
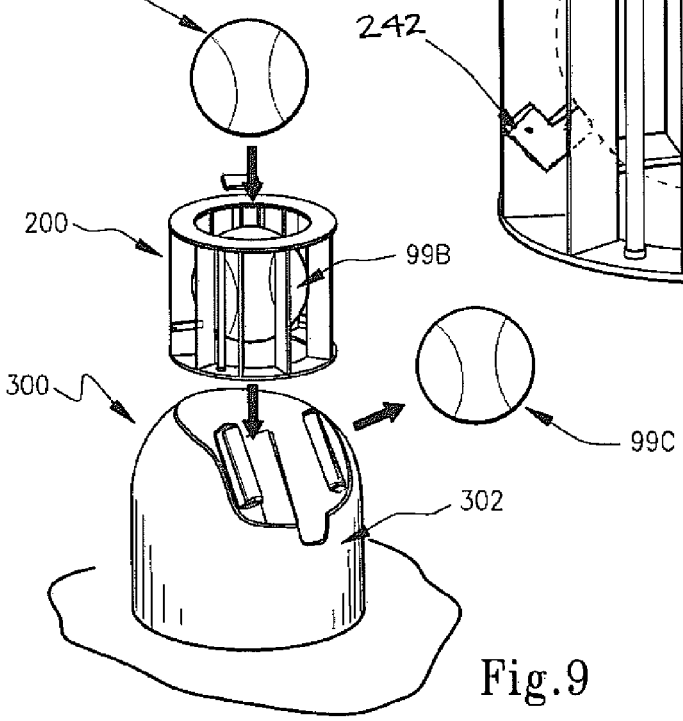
FIG. 9 is a perspective view of a basketball escapement and projecting device.
Figures 11A, 11B, 11C:
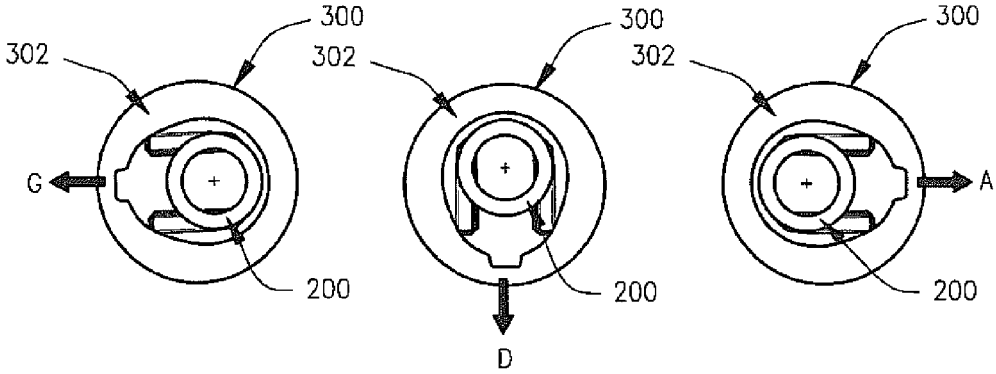
FIG. 11A-C are top views of a projecting device having various rotational orientations that enable ball delivery to various locations on a playing surface.

A general schematic of how a sequence of balls enter escapement 200 is shown in FIG. 8. FIG. 8 shows a cutout of escapement 200 showing only a portion of the top 202, the bottom 206, and side portion 204 and levers 242 and 244. The simplified schematic of FIG. 8 shows how the balls are sequentially handled by escapement 200. Thus, a first collected ball 99C is found in the escapement 200 below a second collected ball, 99B, which is followed by a third collected ball, 99A. Thus, the escapement organizes balls that are shot towards goal 800 and collected by collector 100.

As illustrated in FIG. 8, the escapement 200 regulates the introduction of basketballs, one at a time, into the projecting device 300. Basketballs enter the escapement 200 at the top, gravity-fed from the collector 100. The first ball (99C) to enter is held in the lowermost position, and prevented from exiting the escapement 200, by three armatures 242 which extend into the interior channel required for the downward path of the ball. In this example, the armatures 242 are equidistantly spaced around the inner circumference of the escapement 200 and provide a three-point support for the ball and prevent the lowermost ball from falling through the escapement to projecting device 300. The second ball (99B) to enter the escapement 200 comes to rest on top of the first ball (99C). This state may be considered the waiting state of the escapement 200, with the lower ball held in place by the three armatures 242 and the upper ball resting on top of the lower ball.

When the system requires that a ball be released into projecting device 300, three solenoids 230 (see FIGS. 13A-14B) are activated which retract the three armatures 242. The lower ball is then free to fall into the projecting device 300. Simultaneously, a second set of three armatures 244, located above the lowermost ball (99C) but below the uppermost ball (99B), are introduced into the space below the upper ball, thereby preventing it from falling through as the lower ball falls away from its supported position. The upper and lower armature sets, 244 and 242, are connected together by three mechanical links or leverage bars 240 (see FIGS. 13A-14B), such that while the lower armatures 242 are retracted, the upper armatures 244 are extended. After a period of time sufficient to allow the lower ball (99C) to fall into the projecting device, the solenoids 230 are de-energized. This causes the lower armatures 242 to extend and the upper armatures 244 to retract, allowing the upper ball (99B) to fall into the lower position. If there is a ball (99A) in the collector 100 chute 190 above the now-lowermost ball, it will come to rest on the lower ball and the sequence will be repeated during a drill session as required to introduce balls into the projecting device. The presence of the lowermost ball (99C) is sensed by a lever-operated sensor 250 and the release sequence described above will only occur if a ball is detected in the lower position.

Figure 12:
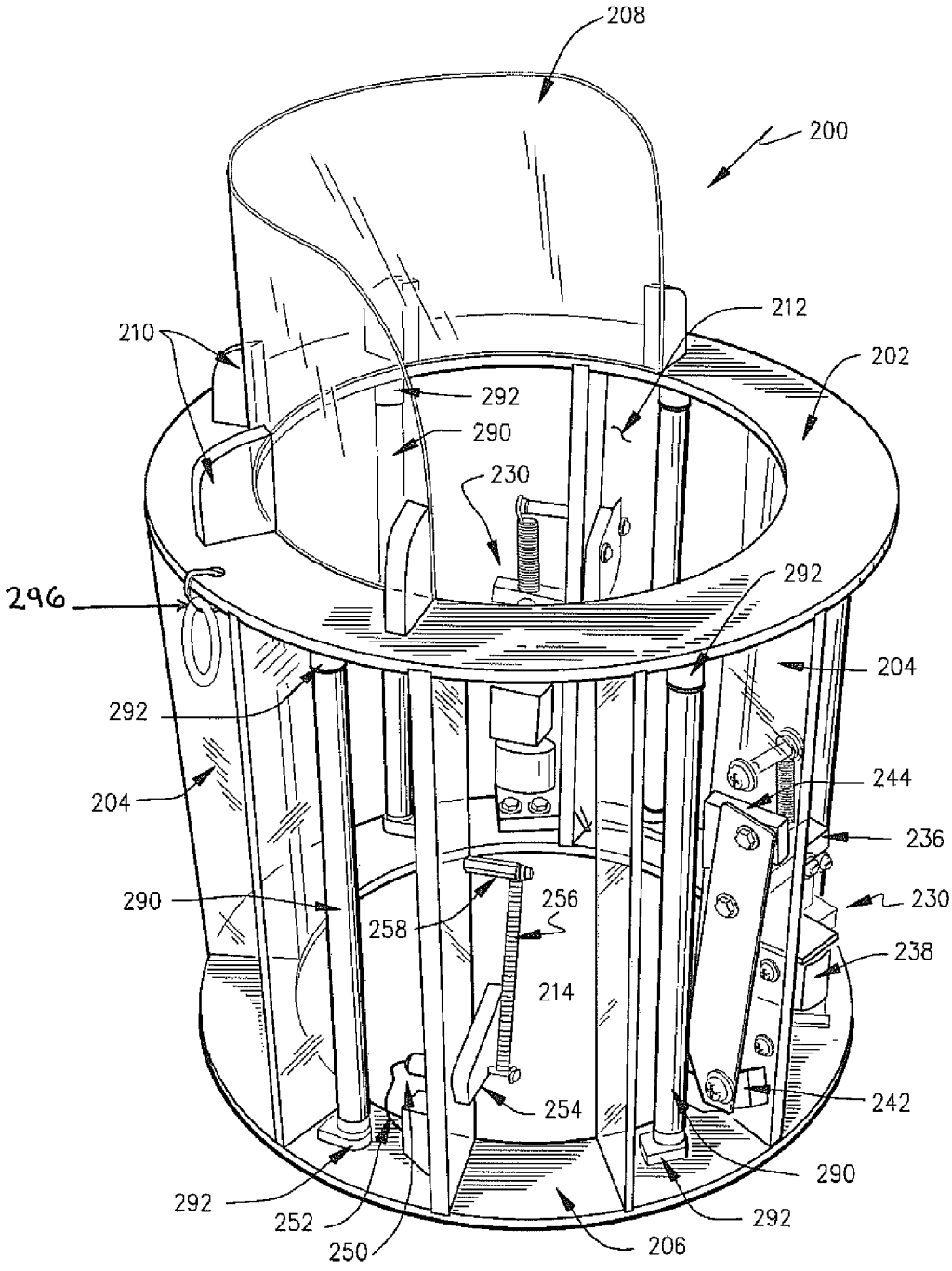
FIG. 12 is a perspective view of a escapement.

FIG. 12 shows an exemplary embodiment of escapement 200 in more detail. As shown, escapement 200 is generally cylindrical in shape and has one or more side portions 204, although it is contemplated that escapement 200 can have various sizes, shapes and configurations. Escapement 200 has a top opening 212 which leads into an interior channel that may follow a central axis, which passes through the interior of escapement 200 and out of a bottom opening 214. The purpose of the interior channel is to allow the passage of basketballs 99 through the escapement 200. The escapement 200 can be variously constructed so that it has one or more side openings, instead of top opening 212 and/or bottom 214. It is also contemplated that in another embodiment of the escapement 200, the interior channel could equally be an open channel not being enclosed one or more sides by a escapement 200 element. Escapement 200 is provided with a backstop 208 which may be supported and stabilized by one or more backstop connector 210 elements. The backstop 208 acts to channel basketballs 99 received from chute 190 and yoke 930 into the escapement 200. Further, the backstop 208 also supports basketballs 99 of various sizes that are maintained within escapement 200.

With reference to FIG. 12, Escapement 200 may employ one or more armatures, 242 and 244, that are operative to engage and retain basketballs 99 within the escapement 200, see also FIG. 7. Armatures 242, 244 may have a basketball engage state, wherein basketballs are supported by the escapement 200 and retained in a waiting state, as shown by 99B of FIG. 7, and a basketball disengage state, wherein basketballs are permitted to move downwardly toward the projecting device 300, such as where a basketball moves from 99B to 99C in FIG. 8 or basketball 99B is released from escapement 200 into projecting device 300 in FIG. 9. Further, the armatures 242, 244 can be placed at various locations within the escapement 200, including being equiangularly spaced about a central axis.

Figure 13A:
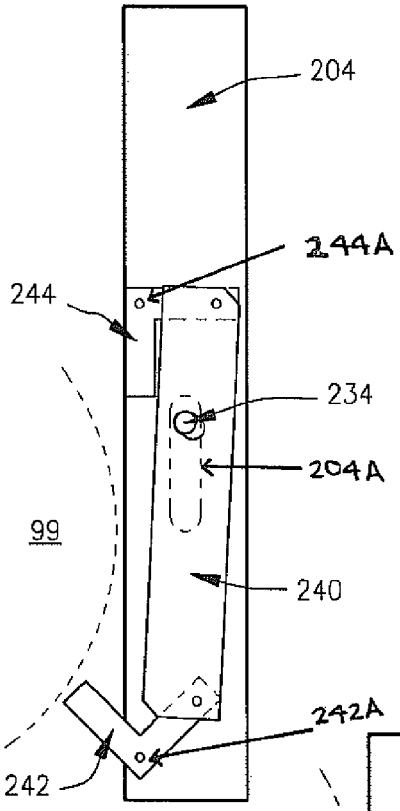
FIG. 13A is a frontal view of a escapement side portion.
Figure 13B:
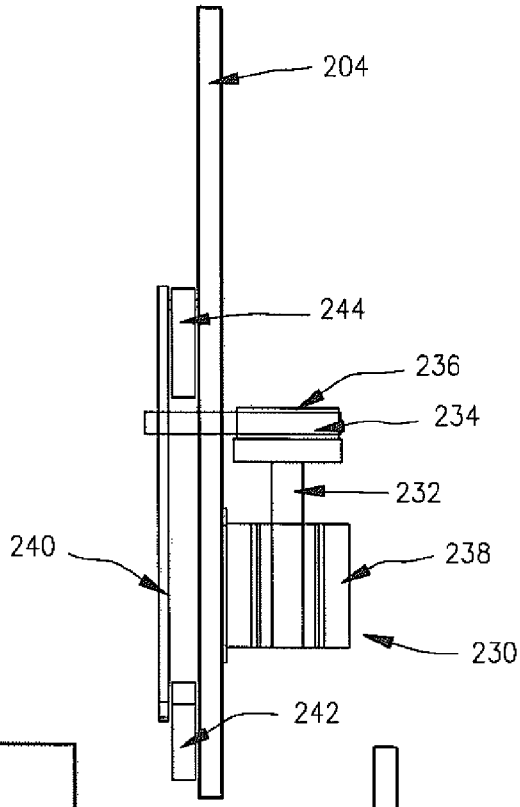
FIG. 13B is a side view of a escapement side portion.
Figure 15:
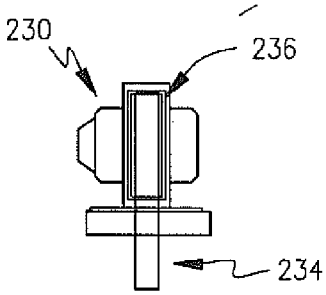
FIG. 15 is a top view of a escapement side portion.
Figure 14A:
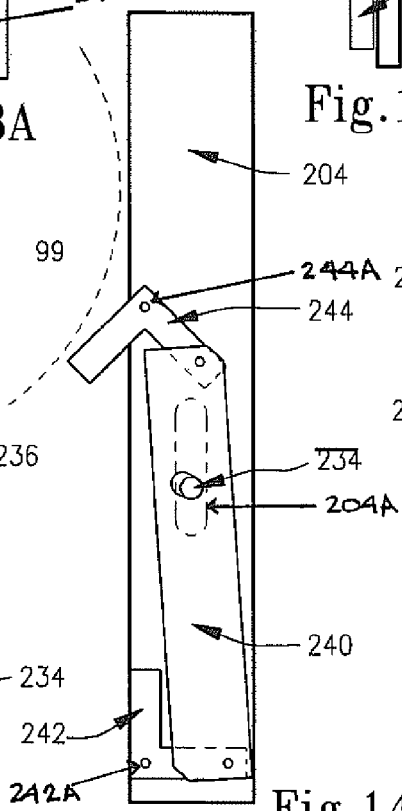
FIG. 14A is a frontal view of a escapement side portion.
Figure 14B:
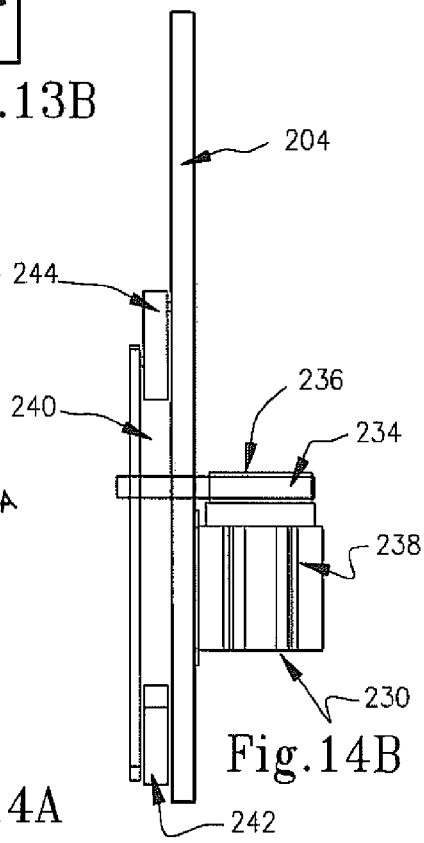
FIG. 14B is a side view of a escapement side portion.

With reference to FIGS. 12, 13A-B, and 14A-B, escapement 200 may have one or more solenoid actuators 230, having a solenoid actuator arm 232, a solenoid actuator head 234, and solenoid actuator body 238. FIG. 13A shows a frontal view of side portion 240 upon which is supported upper armature 244 and lower armature 242 having armature pivot points 242A and 244A, respectively. FIG. 13B shows a side view of this arrangement. As illustrated in FIGS. 13B and 14B, when solenoid actuator 230 is activated, the solenoid actuator head 234 moves between locations that are proximal and distal to solenoid actuator body 238. Escapement 200 may be provided with leverage bar 240, lower armature 242, upper armature 244, armature pivot point 242A, and armature pivot point 244A. Armatures 242, 244 may be moveably connected, such as at a pivot point, to side portion 204. Further, armatures 242, 244 may be moveably connected to a leverage bar 240. In the embodiment shown in the figures, armatures 242, 244, each being moveably connected to side portion 204 at a distance from one another, are each also moveably connected, at a distance from side portion 204, to leverage bar 240, such that armatures 242, 244 both move in concert with the movement of leverage bar 240. As shown in FIG. 13B, the movement of solenoid actuator head 234 may be coupled to leverage bar 240 by mounting the solenoid actuator 230 opposite from the armatures and leverage bar 240 on side portion 240, see FIGS. 13B and 14B, and coupling the solenoid actuator head 234 to leverage bar 240 by connecting arm 236 to solenoid head 234 and leverage bar 240 and passing arm 236 through an interior channel 204A in side portion 204. A top view of this arrangement is shown in FIG. 15. Thus, as shown in FIGS. 13A-B and 14A-B, movement of the solenoid actuator head 234 causes movement of leverage bar 240, which being coupled to armatures 242, 244, causes movement of armatures 242 and 244, allowing the armatures 242, 244 to variously assume basketball engage and disengaged states as described above. FIG. 13A-B, show the solenoid actuator head 234 and arm 236 at a location that is distal to the solenoid actuator body 238. In this configuration, leverage bar 240 is displaced upwardly, causing moveably attached armature 244 to assume a basketball disengaged state and armature 242 to assume a basketball engage state. FIG. 14A-B, show the solenoid actuator head 234 and arm 236 at a location that is proximal to the solenoid actuator body 238. In this configuration, leverage bar 240 is displaced downwardly, causing moveably attached armature 244 to assume a basketball engage state and armature 242 to assume a basketball disengaged state. It is contemplated that leverage bar 240 may be optionally coupled to one or more armatures, allowing one or more armature to variously assume basketball engage and disengage states. From the diagram and the movement of armatures 242, 244, it becomes evident how basketball 99A, FIG. 13A, is supported by escapement 200 when armature 242 is in a basketball engage state and released from the escapement 200 when armature 242 assumes a basketball disengaged state, as shown in FIG. 14A. Furthermore, it can be seen from FIGS. 13A and 14A that armatures 242 and 244 can assume different engage and disengaged states, thus permitting the simultaneous, alternating disengagement and engagement of basketballs 99 in escapement 200. Furthermore, from the Figures it is evident that escapement 200 can be constructed to support one or more basketballs 99 received from basketball collector 100 in a waiting state. Furthermore, it is evident that escapement 200, via this mechanism, may also dispense received basketballs from its interior channel to projecting device 300 when aligned properly in space. Referring to FIG. 12, escapement 200 is also provided with ball present lever 254 that is spring 256 biased towards the interior channel of escapement 200 and electromagnetically coupled with sensor 250 to relay information regarding the presence or absence of a basketball within the interior channel of escapement 200. It should be understood that various other means, as are known in the art, for sensing the presence of the ball may be employed.

Escapement 200 is provided with electrical power, for running its various powered components, which may be provided from an external source, such as a power from a wall plug, generator, or external battery. Power may also be from a self-contained source such as a battery or power supplied from another part of the basketball return machine 10 or, optionally, the goal unit 20.

Figure 16:
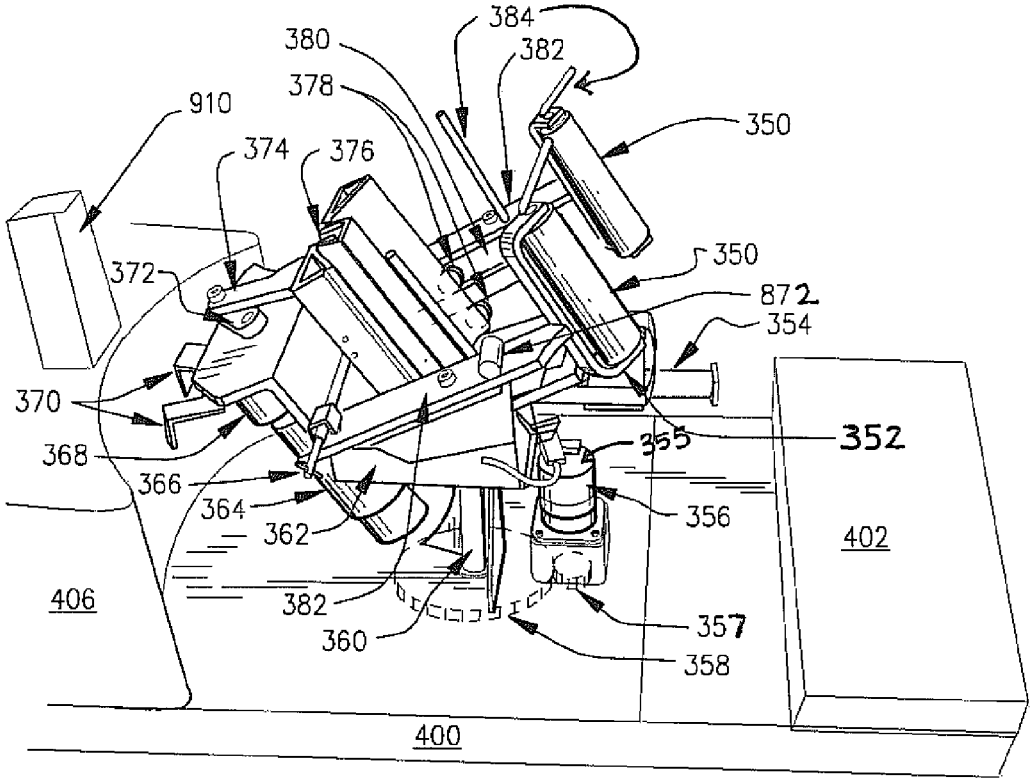
FIG. 16 is a perspective view of a projecting device.

FIG. 6 shows projecting device 300 supported by first base platform 400. FIG. 9 shows that housing 302 encloses the projectile device 300. The interior of projecting device 300 is shown in FIG. 16. Housing 302 is supported by housing front end 354 and housing support brackets 370 wherein the housing 302 is secured thereby with a pin. Housing 302 forms an outer barrier protecting the interior of the projecting device 300 and its mechanics from interference and protecting users of basketball projecting mechanism 300 from harm.

Referring now to FIG. 16, it shows that pivot gear motor 356 includes component gear 357, shown in phantom below motor 355 in FIG. 16. It is contemplated that the component gear 357 of pivot gear motor 356 may be either a constitutive or separate component. Component gear 357 engages pivot gear 358 so as to provide a means for rotating pivot gear 358. Pivot gear 358 is also fixably coupled to support shaft 360. The interaction between the pivot gear motor 356 and the pivot gear 358, together with support shaft 360, provides the means by which the projectile mechanism 300 can be rotated in a horizontal plane and project basketballs about the periphery of the basketball return machine 10. Such rotation permits the projecting device 300 to deliver basketballs to various locations around the periphery of basketball return machine 10 and goal 800. Support shaft 360 supports projectile mechanism housing 362.

At the position in the projectile mechanism housing distal from the point at which basketballs are ejected from the projecting device 300 to a delivery location on the playing surface, hereinafter the rear of projecting device 300, is projectile gear motor 364. Projectile gear motor 364 is fixably attached to a first linkage bar 372. Projectile gear motor 364 causes first linkage bar 372 to rotate about a rotational axis. First linkage bar 372 is moveably attached to a second linkage bar 374 at a distance from the rotational axis. The second linkage bar 374 is connected at the rear of push plate 376. Activation of gear motor 364 causes the rotation of first linkage bar 372 about the rotational axis, which causes the second linkage bar 374, to which it is moveably attached, to displace push plate 376 forwardly and rearwardly as first linkage bar 372 is rotated about the rotational axis. The displacement of push plate 376 is confined by the sides of projectile mechanism housing 362, within which push plate 376 is housed and guided by track 380 and rollers 378. Thus, with the engagement of gear motor 364, push plate 376 is displaced forwards and backwards within the projectile mechanism housing 362. A cavity, which supports a basketball in a ready state, is formed in the projecting device 300 when the push plate 376 is located in a generally rearward position, at the back projectile mechanism housing 362, further defined by having roller arms 382 on the sides and a forward opening framed by rollers 350 at the front of the projecting device 300. Ball guides 384 are provided to stabilize and contain basketballs received from the escapement 200 and supported in the cavity.

At the front of the projecting device are rollers 350, that are spaced a distance apart from one another at the front of the projectile mechanism housing 362. This distance that the rollers 350 are spaced apart can be varied by utilizing the roller distance screw 366. The roller distance screw permits the transverse distance of the projectile mechanism housing 362 to be varied, thus varying the distance that the rollers 350 are spaced apart from one another. It is also contemplated that in another embodiment, the rollers 350 or rollers 350 and roller arms 382 could be moveably adjusted. In FIG. 16, varying the transverse distance of the projectile mechanism housing 362 varies the distance between the rollers 350. Varying the distance between the rollers 350 causes the distance that a basketball is projected to vary. Decreasing the distance between rollers 350 causes the distance that a ball is projected from projecting device 300 to increase. Similarly, increasing the distance between rollers 350 causes the distance that a ball is projected from projecting device 300 to decrease. With all of this in mind, it is contemplated that one or more roller 350 may be employed for these purposes.

The function of the push plate 376 propulsion mechanism is to launch the basketball in a trajectory toward the player, on an azimuth determined by the aiming point at which the is directed. The push plate 376 propulsion mechanism forces a ball between rollers 350. This causes the spherical ball to be deformed and significantly compresses the air inside the ball. At the point at which the push plate 367 has forced the maximum diameter of the ball beyond the rollers 350 (the "half-way" point) the ball enters a phase of restitution to its normal spherical shape. The air compressed inside the ball rapidly expands the envelope of the ball, pushing against the forward surfaces of the rollers 350, and launching the ball at a velocity proportional to the increased air pressure.

In use, as shown in FIG. 9, basketball, 99B, is supported by escapement 200 in a waiting state. When suitably spatially aligned, as shown, a basketball is released from escapement 200 to the projecting device 300. A basketball is received in cavity, as discussed above, of the projecting device 300. The basketball is supported in the cavity of the projecting device 300 and maintained in a ready state prior to delivery of the basketball to a delivery location on a playing surface. In order to deliver a basketball to a delivery location, the gear motor 364 is activated, causing rotation of first linkage bar 372 about the rotational axis, which causes the second linkage bar 374, to which it is moveably attached, to displace push plate 376 forwardly, as first linkage bar 372 is rotated about the rotational axis, causing a ball positioned in the cavity to be forced in a forward direction and through rollers 350. Forcing a basketball through rollers 350 with push plate 376, as discussed above, causes the ball to travel forward toward a deliver location. Experience suggests that the projecting mechanism housing 362 is ideally positioned at an angle of twenty-three (23) degrees relative to first base platform 400 in order to provide a person with a ball in the vicinity of the human chest region at a delivery location. It is contemplated that the vertical angle at which the projecting mechanism housing 362 is supported can be varied to vary the trajectory of a basketball projected from the projecting device 300 to one or more delivery locations.

The projecting device 300 projectile mechanism housing 362 rotates through 180 degrees of azimuth to facilitate aiming the direction of the ball when launched. An optical encoder is used to sense the absolute azimuth of the projectile mechanism housing 362 and to delineate the aiming points spaced within the 180 degree arc of rotation. The rotation of the projectile mechanism housing 362 is driven by a 90V DC gearmotor under bi-directional control of a motor controller. The motor controller is in turn under the control of the microcontroller program.

Projecting device 300 is provided with electrical power, for running its various powered components, which may be provided from an external source, such as a power from a wall plug, generator, or external battery, or self-contained source such as a battery or power supplied from another part of the basketball return machine 10 or, optionally, the goal unit 20.

With reference to FIG. 1, the basketball collector 100 is shown in the deployed state. The basketball collector 100 is positioned beneath basketball goal 800 to receive basketballs shot towards goal 800. Collector 100 is comprised of a netted framework 110 that spans beneath basketball goal 800. Netted framework 110 may have an upper portion 110B having a generally rectangular geometry, which prevents basketballs shot towards goal 800 and received within the netted framework 110 from escaping from the interior of the netted framework 110. The netted framework 110 may also have a lower portion 110A having upside-down, truncated pyramidal geometry, that tapers downwardly toward escapement 200, which acts to funnel basketballs downwards. Lower portion 110A may also have a chute 190 that is downwardly sloped and interfaces between the netted framework 110 and escapement 200 for funneling received basketballs into escapement 200. As shown in FIG. 7, the netted framework 110 and chute 190 are attached to the yoke 930. The means of attaching the netted framework and chute 190 to the yoke 930 may be buckles, hook and loop fastener, and the like. Netted framework 110 may be of various sizes and configurations, including but not limited to adult, junior and pee wee.

Figure 20:
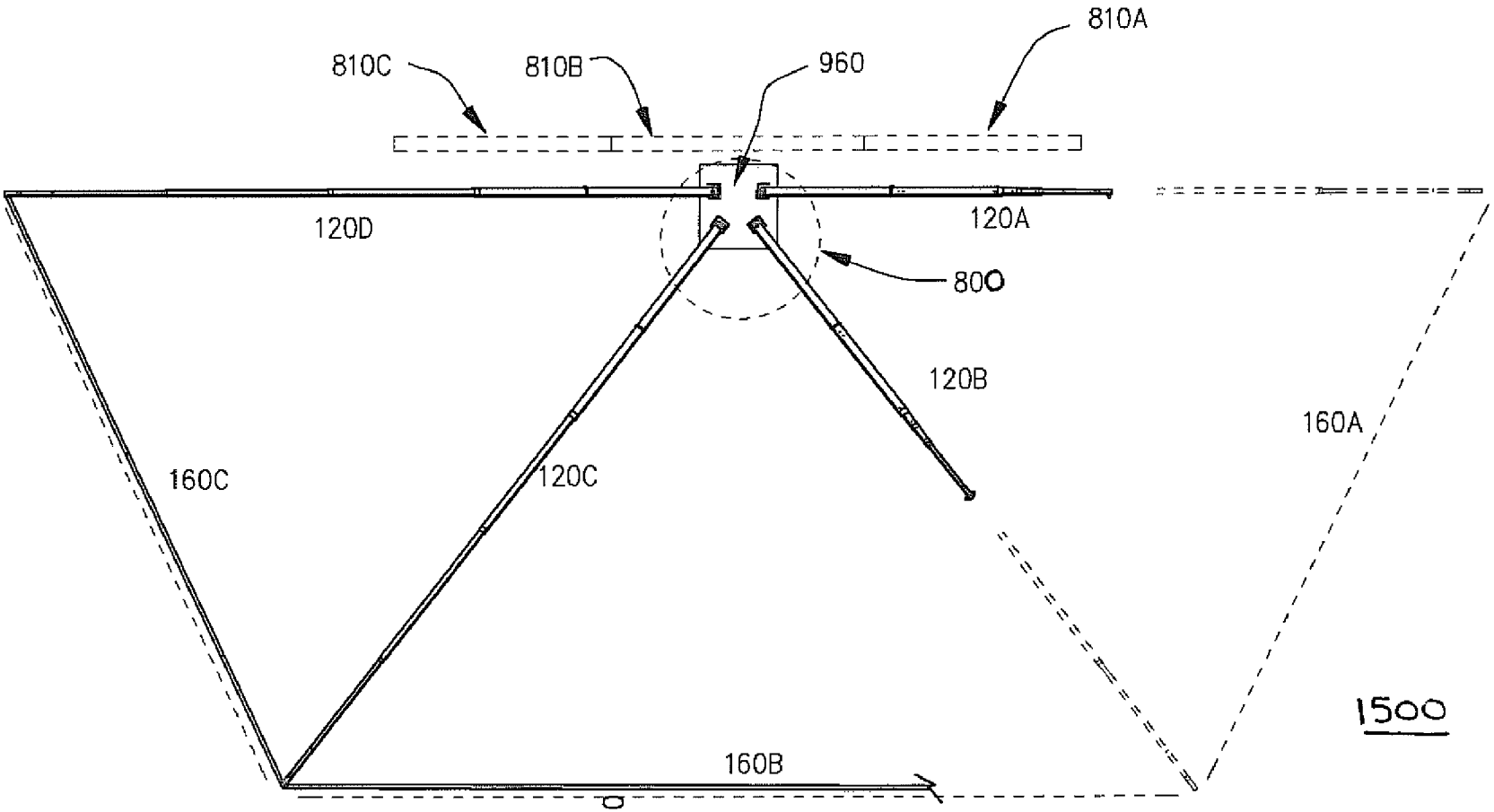
FIG. 20 is a top view depicting a pedestal from which extend extension arms, which are spanned by stabilizers.
Figures 21, 22, 23:
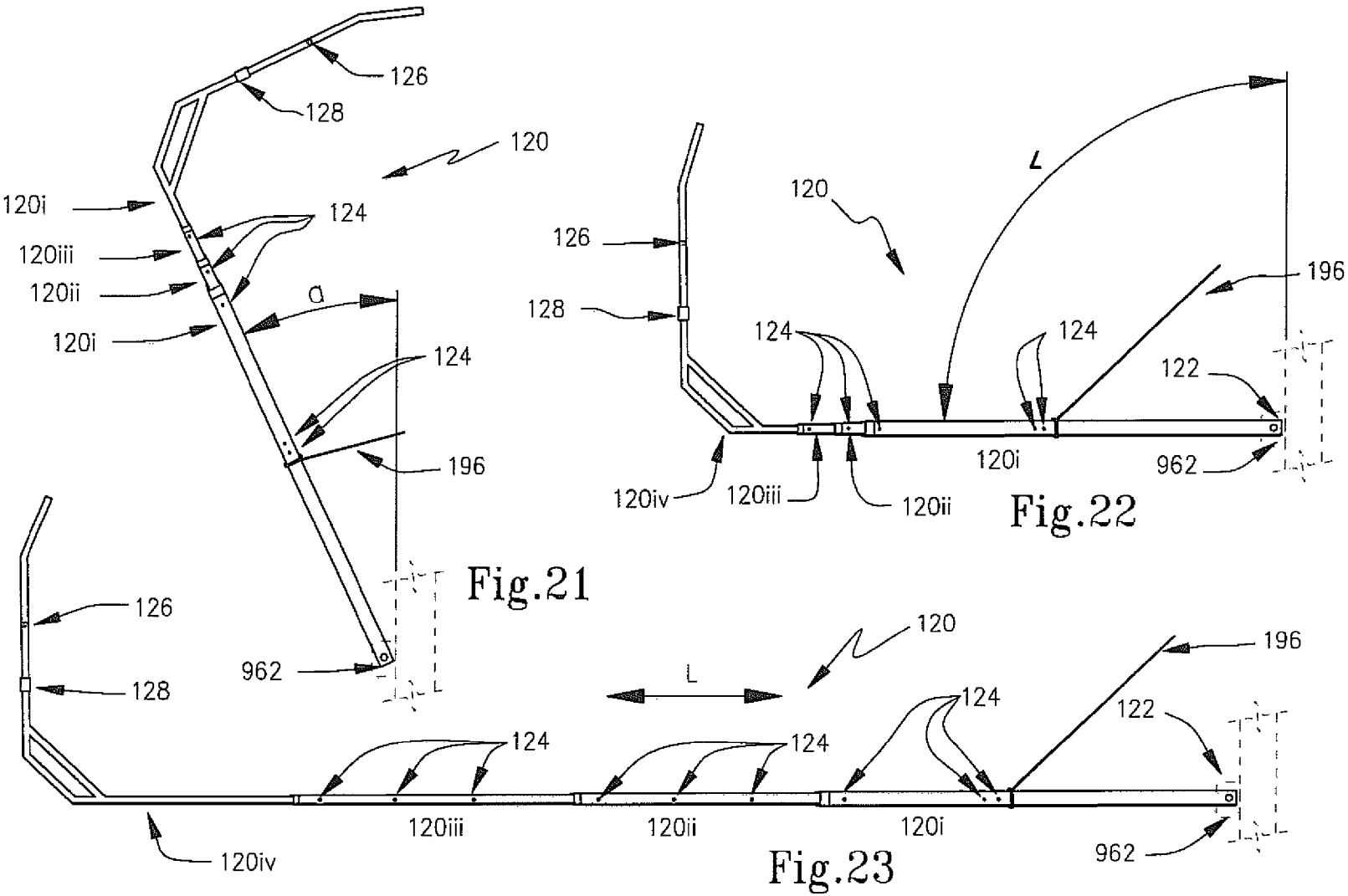
FIG. 21 is a side view of an extension arm in a retracted state.
FIG. 22 is a side view of an extension arm in a retracted state.
FIG. 23 is a side view of an extension arm in an extended state.

Supporting the netted framework 110 are a plurality of extension arms 120. FIG. 20 shows a downward view of the extension arms 120A-D of FIG. 1. The figure shows in phantom pedestal 960 to which the proximal ends of extension arms 120 are moveably attached. Also shown in phantom is backboard 810 and goal 800. FIG. 20 shows how extension arms 120 may have an extended state and a retracted state, meaning they are adapted to move as the netted framework moves from a folded state to a deployed state and vice versa. FIG. 23 shows extension arm 120 in an extended state, having a proximal end, located at the pedestal extension arm interface 962 which is shown in phantom, a distal end and plurality of arm segments therebetween, 120*i-iv*. Also shown are the previously discusses rope ratchets 198 that connect to extension arms 120. FIG. 23 also shows how each arm segment, i-iv, may have one or more snap button holes 124 allowing engagement of a snap button mechanism in the various snap button holes 124 to permit extension arms 120 to vary in size. It is contemplated that the extension arms 120 may be telescopic, vary in length in discreet increments, or vary in length indiscriminately. FIG. 22 shows extension arm 120 in a retracted state, with arm segments 120*i-iv* being telescopic and having a proximal end having a hinge point 122 that intersects with pedestal 960 at the pedestal extension arm interface 962. FIG. 21 shows the extension arm 120 in a retracted state and extension arm 120 assuming a configuration consistent with the basketball collector 100 being in a folded state, as shown in FIG. 2. Each of the extension arms 120 shown in FIG. 2 are in a retracted state. When the basketball collector 100 is in a folded state, the extension arms 120 each assume a retracted state. When the basketball collector 100 is in the deployed state, it can be appreciated that the extension arms 120, due to the varying engagement of snap button holes 124 by a snap button mechanism, may vary in length. Thus, the size of the basketball collector 100 can be varied by varying the length of the extension arms 120. It is contemplated that other means may be employed to vary the length of extension arms 120, including pins utilized in conjunction with holes.

Figure 24:
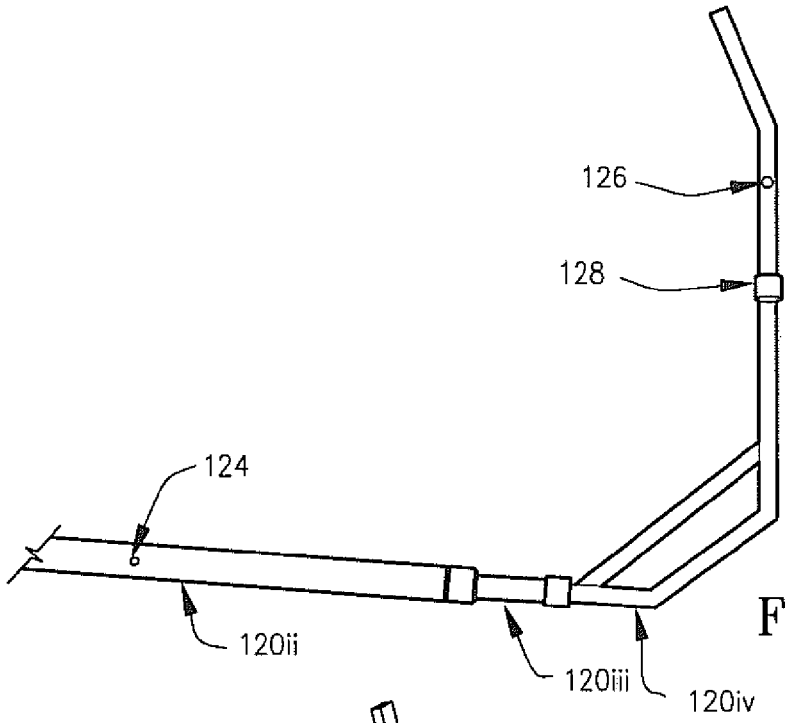
FIG. 24 is a side view of a portion of the distal end of an extension arm sub-assembly.
Figure 25A:
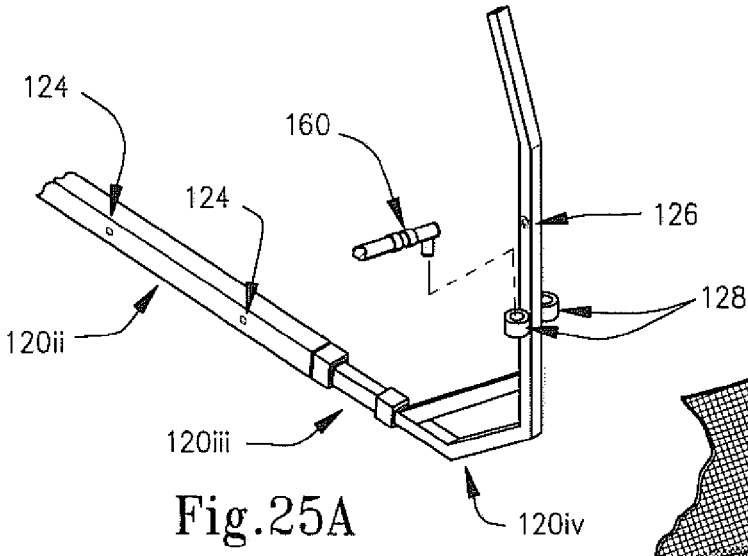
FIG. 25A is a perspective view of the distal end of an extension arm sub-assembly.
Figure 25B:
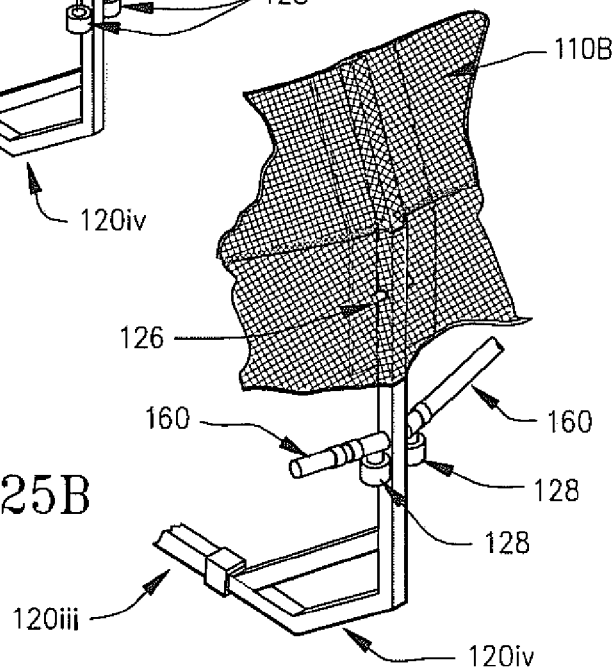
FIG. 25B is a perspective view of the distal end of an extension arm sub-assembly engaging a portion of netted framework and stabilizers.

In the deployed state, the netted framework is in an expanded configuration, and due to the ways in which the size of the extension arms 120 may be varied, there may be a plurality of deployed states, e.g. peewee, junior and adult. In the folded state, the basketball collector 100 has a netted framework 110 that is in a collapsed configuration. The netted framework 110 is interfaced with the extension arms 120 as shown in FIG. 1. Furthermore, the way in which the netted framework 110 interfaces with the extension arms 120 may be understood by reference to FIGS. 24 and 25A and B. The distal end arm segment, 120*iv*, of extension arm 120 may have a configuration as shown in FIG. 24, generally having a horizontal section provided with a distal end having a generally vertical support element, which may have a tip that is biased inwardly relative to a basketball goal. The vertical support element may be reinforced, as shown in FIGS. 24 and 25A-B, by a support segment which provides structural strength and stability to the vertical support element. Furthermore, distal end arm segment 120*iv* is also provided with donut connection points 128, that provide an interface on extension arm 120 for stabilizers 160, and a pair of grommets 126, which provides a connection point on extension arm 120 for collecting net 110. Referring to FIG. 25A, it can be seen how stabilizer 160 has a distal tip that interconnects with a void in donut connection point 128. Thus, stabilizers 160 may be secured to extension arms 120 at donut connection points 128 to stabilize and locate extension arms in extended states, as depicted in FIG. 20. As shown in FIG. 25B, the netted framework 110, particularly the upper portion 110B, may be slid over the vertical support element of distal end arm segment, 120*iv*, of extension arm 120 and secured thereto by a pair of grommets 126 and pin fastener. Further, netted framework 110 may be secured to the stabilizers 160 via netted framework straps 112, which may be hook and loop fastener.

The cross sectional geometry employed for extension arms 120 is preferably ob-round, which provides strength and torsional stability to the extension arms 120.

The basketball collector 100 is shown in FIG. 3B in the folded state with the netted framework 110 in a collapsed configuration. The circumference of netted framework 110 is secured and supported by netted framework strap 194. Furthermore, the extension arms 120 may be in retracted states as depicted in FIG. 3B and supported adjacent to mast 900 by rope ratchets 198 and extension arms towards bracket 904.

In the second exemplary embodiment of the present disclosure, the basketball return machine 10 is interfaced with goal unit 20 to form a removeably coupled basketball return machine 10 and goal unit 20. The second exemplary embodiment of the present disclosure is shown in FIG. 3B. FIG. 3A shows that the basketball return machine 10 and goal unit 20 are removeably joined together. The basketball return machine 10 and goal unit 20 may be coupled at points on the first base platform 400 and second base platform 500 and further joined with first goal post strut 696 and second goal post strut 698 connecting to the structure supported by first base platform 400. Second base platform 500 supports goal post 600. Second base platform 500 may be fixed in location or portable, and may include wheels 410 or other features that enable it to be portable.

Second base platform 500 is provided with electrical power, for running its various powered components, which may be provided from an external source, such as a power from a wall plug, generator, or external battery, or self-contained source such as a battery or power supplied from another part of the goal unit 20 or, optionally, basketball return machine 10.

Second base platform 500 supports a goal post 600 which may have a lower goal post 602. The goal post 600 may telescope in relation to lower goal post 602. The height of the goal post 600 may be varied to discrete lengths or indiscriminately. As shown in FIG. 3B, the goal post 600 has goal post height selector holes 604A, 604B, and 604C that may be selectively engaged by a pin that resides in collar 606. Collar 606 is generally of a fixed height and does not move relative to goal post 600. As shown in FIG. 3B, first goal post strut 696 and second goal post strut 698 engage collar 606 and maintain it at a fixed height relative to the playing surface 1500. Goal post 600 is constructed so as to pass freely through the interior of collar 606. It is contemplated that the collar 606 and goal post 600 may be configured in other ways to permit the goal post 600 to pass past the collar 606. The collar 606 has a pin which passes through and engages both the collar 606 and goal post 600. The pin of collar 606 may optionally engage goal post height selector holes 604A, B, or C to vary the height of the goal post 600. Further, as depicted in FIGS. 3A and 3B, the pin of collar 606 and goal post 600 may be adapted so that the pin is engaged in a lowered state hole in both the collar 606 and goal post 600 when the goal post is in a lowered state. The goal post height selector holes 604 may be configured so as to define different discreet heights, including but not limited to heights of 8 feet, 9 feet and 10 feet. First goal post strut 696 and second goal post strut 698 engage collar 606 and maintain it at a fixed height relative to the playing surface 1500.

FIG. 6 shows goal post lift 620 which provides a means by which goal post 600 may be raised. The goal post lift 620 is provided to aid in lifting the goal post 600 to a desired height. Goal post lift 620 has a goal post and goal post lift connection point 632, as seen in FIG. 6, wherein the goal post lift 620 connects to the goal post 600. The goal post lift 620 is supported on second base platform 500 by goal post lift support 630. Goal post lift support 630 supports a lift mechanism 626 whose upper portion interfaces with goal post lift 620 or an interface thereof. Lift mechanism 626 in the present disclosure may be a camper jack, or other mechanical or electromechanical motor driven mechanized lift mechanism. FIG. 3B shows the goal post 600 in a lowered state first, for example where the goal unit 20 was being stored, and FIG. 6 shows the goal post 600 in a raised state, at a height utilized for basketball play. FIG. 3B shows how the backboard 810 is supported upon goal post 600 by lift mechanism 700. Lastly, elements identified in FIG. 3B as 610 are ball bag anchors.

Goal post 600 is provided with electrical power, for running its various powered components, which may be provided from an external source, such as a power from a wall plug, generator, or external battery, or self-contained source such as a battery or power supplied from another part of the goal unit 20 or, optionally, basketball return machine 10.

Figure 27:
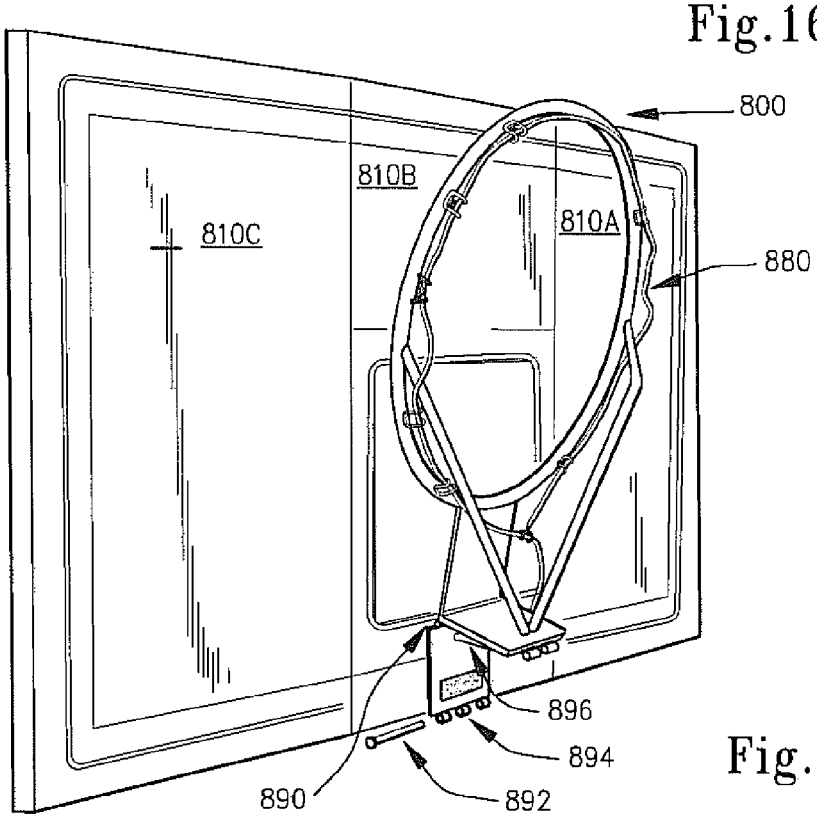
FIG. 27 is a perspective view of a backboard and goal, the goal being in a raised storage position.
Figure 26:
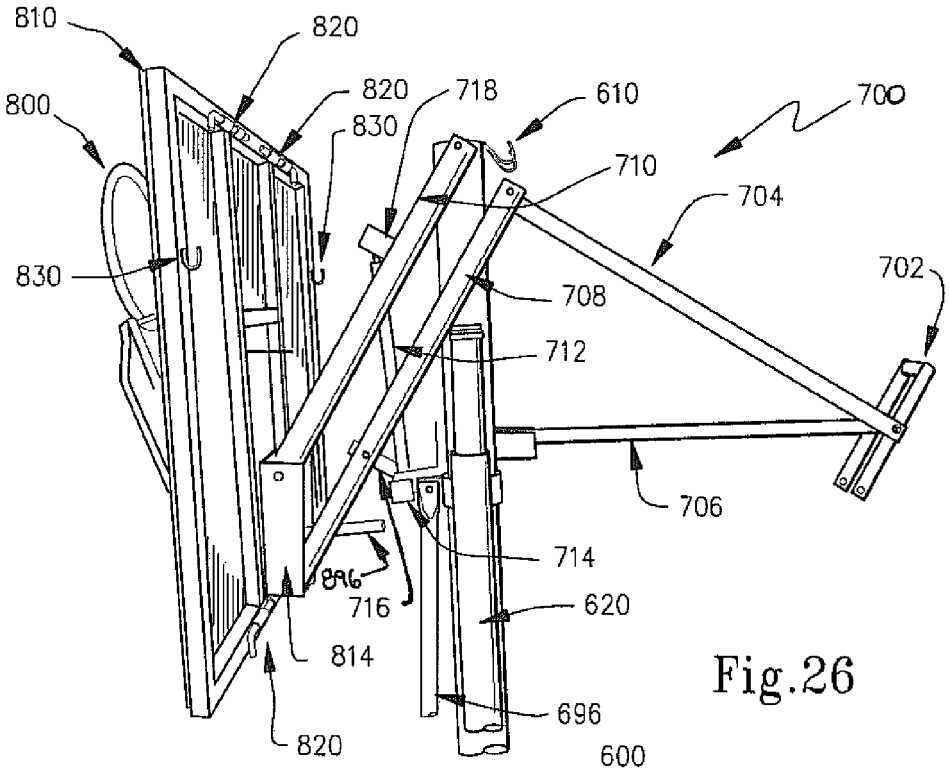
FIG. 26 is a perspective view of the backboard and lift mechanism region.

FIG. 3B depicts how backboard 810 and goal 800 are supported upon goal post 600 by lift mechanism 700. Lift mechanism 700 connects with backboard 810 at the backboard support plate 814, as shown in FIG. 26. FIG. 27 discloses goal 800 being pivotally supported on backboard 810, with backboard 810 being comprised of three optionally collapsible sections 810A, 810B, and 810C. FIG. 3A shows backboard having hinges along horizontal axes 812 such that the backboard section 810A-C are hinged together and may be folded as shown in FIG. 6. The backboard hinged sections 810 A-C may be collapsed together, 810A to 810B and 810C to 810B, such that the backboard 810 assumes a folded state, which can provide backboard 810 with a reduced profile for storage purposes. Equally, backboard 810 may assume a deployed state, shown in FIG. 27, the deployed state being planar and the configuration used for playing basketball. In the deployed state, latch pins 820, as shown in FIGS. 26 and 3B, are utilized to secure the backboard sections 810A, B, C in a planer orientation.

Figure 28:
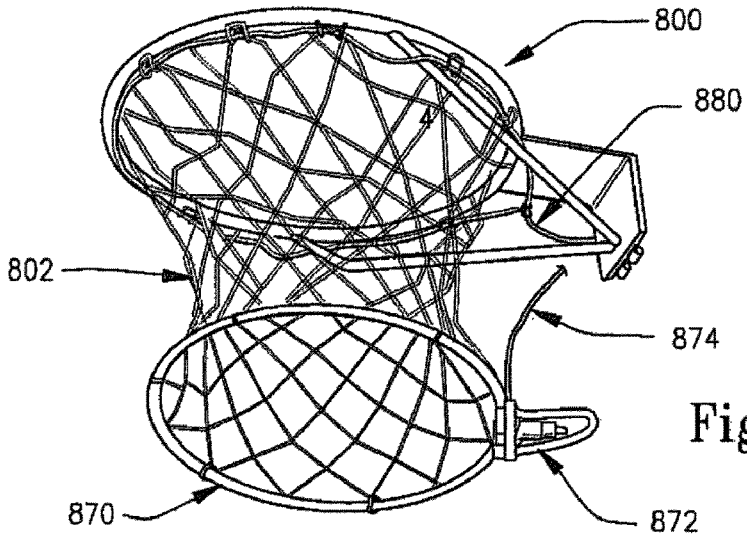
FIG. 28 is a perspective view of a goal in a lowered play position.

FIG. 27 shows that goal 800 is pivotally supported by goal hinge 890 which permits the upper portion of the goal 800 and backboard 810 interface to pivot along the vertical axis defined by 890. Goal 800 is supported in an upward, stored position and maintained in an upper position by rim storage pin 896 which slides through the back of the backboard 810 and locks in a position underneath the goal 800, as shown in FIG. 27. This fixes goal 800 in an upward orientation for storage purposes. To lower the goal 800, rim storage pin 896 is withdrawn rearward toward the back of backboard 810. When rim storage pin 896 is withdrawn it permits the goal 800 and goal net 802 to assume a basketball play position as shown in FIG. 28. Once lowered to a play position, the goal latch 894 will align with the goal latch portions of the goal 800, permitting the goal latch pin 892 to secure the lower portion of goal 800 with the backboard 810.

One of the features of the backboard 810 are backboard collector connections 830, as shown in FIGS. 26 and 3B, that permit the basketball collector 100 to interface with the backboard 810 and assume a configuration as shown FIG. 1, wherein the upper portion of netted framework 110, 110B, is connected to backboard 810, permitting the basketball collector 100 to span the region immediately adjacent and behind the backboard 810.

Turning to FIG. 28, the goal unit 800 is disclosed along with goal net 802. Also shown is bottom ring 870 to which is connected sensor 872, which may be a light sensor. Sensor 872 may be utilized to count basketballs that successfully pass through the goal 800 and net. Further, sensor 872 may be interfaced with a computer or other counting device.

FIG. 28 also depicts illumination element 880 which may be used to provide illumination in and around goal 800.

Goal 800 is provided with electrical power, for running its various powered components, which may be provided from an external source, such as a power from a wall plug, generator, or external battery, or self-contained source such as a battery or power supplied from another part of the goal unit 20 or, optionally, basketball return machine 10.

Lift mechanism 700 is depicted in FIG. 26. Backboard lift mechanism 700 may have a lowered state, as shown in FIG. 3B, wherein backboard 810 is in a lowered orientation. Lift mechanism 700 may also have a raised state, as shown in FIG. 6, wherein backboard 810 is in an elevated orientation that permits the goal 800 and backboard 810 to utilized for basketball play or practice.

Referring to FIG. 26, the backboard lift mechanism 700 has a handle 702, which, as it is lowered, causes the backboard lift mechanism 700 to lift backboard 810 upward. Lift handle 702 is connected to a rear upper arms 704 and rear lower arms 706. Rear arms 706 are moveably connected, such as via a hinge mechanism, to goal post 600. Front lower arms 708 are moveably connected to rear upper arms 704 at a point rearward of goal post 600. Front lower arms 708 are also moveably connected at a lower portion of backboard support plate 814. Front upper arms 710 are moveably connected to the top of goal post 600 and extend to moveably connect to the upper portion of backboard support plate 814. Supported on goal post 600 is lower lift connection point 714 which is connected to a lower end portion of lift cylinder 712. Radiating generally upward from front upper arm 710 is upper lift connection point 718, which is connected to the other end portion of lift cylinder 712. The lift cylinder 712 may provide an upward force to facilitate the upward movement of lift mechanism 700 and, equally, slow the downward movement of lift mechanism 700. With regard to a backboard 810 having significant mass, the properties of the lift cylinder 712 can make the process of raising backboard 810 with lift mechanism 700 easier and regulate the rate of decent in utilizing lift mechanism 700 to lower such a backboard. Lift latch 716 is also depicted which is moveably connected to lower lift connection point 714 and releasably attaches to front lower arm 708, to enable lift mechanism 700 to be locked in a lowered state. Lift latch 716 may have a latched state, wherein lift latch 716 is attached to front lower arm 708 thereby locking lift mechanism 700 in a lowered state, and a released state, wherein lift latch 716 is not attached to front lower arm 708 thereby allowing lift mechanism 700 to move freely between a lowered state and a raised state. The movable connections contemplated for use in conjunction with the various components of lift mechanism 700 include a hinge.

In the basketball return machine 10 use state generally: a) collector 100 is in a deployed state positioned beneath a basketball goal and receive basketballs shot towards the goal, with extension arms 120 in an extended state; b) yoke 930 couples the lower end of the basketball collector 100 to escapement 200 and permit received basketballs to be fed into escapement 200; c) escapement 200 is positioned beneath the collector 100 and be operative to receive and support basketballs retrieved by the basketball collector 100 and dispense received basketballs to projecting device 300; and d) projecting device 300 must be operative to receive basketballs from escapement 200, support them in a ready state and deliver them to one or more locations on a playing surface.

In order to convert the basketball return machine 10 from a storage state to a use state, several steps are required. For the sake of reference, FIG. 2 shows the basketball return machine 10 in a storage state and FIG. 1 shows the basketball return machine 10 in a use state.

First, collector 100 must assume a deployed state positioned beneath a basketball goal and receive basketballs shot towards the goal, with extension arms 120 in an extended state. Referring to FIG. 2, it shows basketball return machine 10 in a storage state, collector 100 in a folded state, and extension arms 120 in retracted states. Starting with FIG. 2, collector 100 may be transitioned to a deployed state by first releasing the netted framework strap 194, as shown in FIG. 3B, which holds netted framework 110 in a collapsed configuration. Next, handle 954 can be used to operate mast movement element 952 so as to change the spatial orientation of pedestal 960, thereby causing mast 900 to move from forward-biased orientation to an upright orientation. From the figures, it can be appreciated that as mast 900 is brought to an upright orientation, extension arms 120A-D are also brought upward. FIG. 2 also shows that extension arms 120 are supported by rope ratchets 198, wherein the rearward most extension arms 120 may be supported in extension arm storage bracket 904. Once mast 900 is in an upright position, depicted in FIG. 7, rope ratchets 198 can be manipulated to lower extension arms 120A-D, which as shown in FIG. 2 are initially in retracted states. Extension arms 120 may be lowered by rope ratchets 198 so that they are in configuration radiating from pedestal 960, shown in FIG. 20. It can be appreciated that as extension arms 120A-D are lowered, as shown in the progression from FIG. 21 to 22, netted framework 110, although in a semi-collapsed state, will span between the extension arms. Extension arms 120A-D, being in retracted states, may then be extended in length so as to assume an extended state, as shown in the progression from FIG. 22 to 23. Selectively engaging variously positioned snap button holes 124 in extension arm 120 arm segments, 120*i-iv*, with a snap button mechanism, permits a person extending an extension arm 120 to vary the length which it is extended. Furthermore, fact that extension arm 120 arm segments may be provided with discreetly positioned snap button holes 124 permits the extension arms to be constructed having discreet lengths, thus permitting the netted framework 110 to have different sizes. Different sizes contemplated by the present disclosure are netted framework 110 sizes that are sized for the particular users, i.e. adult, junior and pee wee. As extension arms 120 move from retracted states to extended states, the netted framework 110, being attached to extension arms 120A-D, spans the distance between the extension arms. Netted framework 110 therefore assumes an expanded state that when positioned beneath a basketball goal, spans beneath the basketball goal. This general configuration is depicted in FIG. 20. With the extension arms in an extended state of a desired length, stabilizers 160 may be attached, see FIG. 25A, between extension arms 120A-D, see FIG. 20, and netted framework straps 112 may be employed to attach netted framework 110 to stabilizers 160 as shown in FIG. 1. When used in conjunction with goal unit 20, netted framework 110 of basketball return machine 10 may be attached to backboard 810 at backboard collector connections 830, shown in FIG. 3B, so as to permit the netted framework 110 to span the region immediately behind the backboard 810. At this point, the netted framework 110 has an expanded configuration and basketball collector 100 is in a deployed state, with extension arms 120 in an extended state. Collector 100, as discussed, may equally be positioned beneath a stand-alone basketball goal 30 or utilized in conjunction with goal unit 20, which in either case permits it to be positioned beneath a basketball goal.

Second, yoke 930 must be coupled to the lower end of the basketball collector 100 to escapement 200 and permit received basketballs to be fed into escapement 200. FIG. 2 shows basketball return machine 10 in a storage state and shows no escapement 200 element whatsoever. It can be appreciated that in a storage state, basketball return machine 10 may have the escapement 200 removed. Escapement 200 may be removed from basketball return machine 10 by disconnecting hopper straps 942A-C, shown in FIG. 7, from yoke straps 940A-C. Referring to FIG. 6, it can be appreciated that yoke 930 can assume a lowered state while supported on mast 900, relative to its in use position, when yoke adjustment turnbuckle 914 does not support lower yoke support arm 916 in space, for example when yoke adjustment turnbuckle 914 is disconnected from either lower yoke support arm 916 or yoke adjustment turnbuckle padeye 912. This allows the yoke 930 to brought in closer proximity to mast 900 for easier storage. To transition the basketball return machine 10 from a storage state to a use state, as discussed above, mast 900 must be brought into an upright position. Further, the yoke adjustment turnbuckle 914 should be connected to yoke 930 and adjusted to position yoke 930 in an optimal spatial arrangement relative to collector 100, chute 190 and escapement 200. In this way, yoke 930 assumes the configuration shown in FIG. 7. As depicted in FIG. 7, yoke 930 is attached to chute 190 of collector 100 by means of buckles, hook and loop fastener, or the like. Escapement 200 may be coupled to the lower end of the basketball collector 100, as shown in FIG. 7, by connecting hopper straps 942A-C to yoke straps 940A-C, respectively. In this way, yoke 930 couples the lower end of the basketball collector 100, specifically chute 190, to hopper 200 and permits received basketballs to be fed into hopper 200.

Third, escapement 200 must be placed beneath the collector 100 and be made operative to receive and support basketballs retrieved by the basketball collector 100 and able to dispense received basketballs to projecting device 300. Once escapement 200 is positioned as shown in FIG. 7, as discussed previously, it is positioned beneath the collector 100 and operative to receive basketballs retrieved by the basketball collector 100. With regard to supporting and dispensing received basketballs to projecting device 300, the means by which that occurs was also previously discussed in detail. Very briefly, referring to FIGS. 13A-B and FIG. 14A-B, it is shown in FIG. 13A how basketball 99 is retained in escapement 200 by armature 242 when the solenoid actuator head 234 of solenoid actuator 230 is at a point distal from solenoid actuator body 238. Further, as shown in FIG. 14A a basketball 99 is dispensed from escapement 200 when solenoid actuator head 234 of solenoid actuator 230 transitioned to a point proximal to solenoid actuator body 238. Thus, escapement 200 may support basketballs retrieved by the basketball collector 100 and dispense received basketballs to projecting device 300.

Fourth, projecting device 300 must be made operative to receive basketballs from escapement 200, support them in a ready state and deliver them to one or more locations on a playing surface. Once the escapement 200 assumes the configuration disclosed in FIG. 7, as discussed above, with respect to projecting device 300, projecting device 300 is then operative to receive basketballs from escapement 200. Furthermore, as discussed previously, projecting device 300 supports basketballs in a cavity formed in the projecting device 300. Furthermore, when powered, projecting device 300 may optionally rotate in a horizontal direction and, via movement of balls through rollers 350 caused by the movement of push plate 376, caused when gear motor 364 is activated, deliver basketballs to one or more locations on a playing surface.

With these steps in mind, it can be appreciated that a person could equally transition a basketball return machine 10 from a use state to a storage state.

In the goal unit 20 use state generally: a) goal post 600 is at a desired height; b) backboard 810 is in a deployed state; c) goal 800 is in a lowered position for play; and d) lift mechanism 700 is in a raised state.

In the goal unit 20 storage state, the goal unit 20 has a reduced profile. A goal unit 20 having a reduced profile is depicted in FIG. 2.

In order to convert the goal unit 20 from a storage state to a use state, several steps are required. For the sake of reference, FIG. 3A shows the goal unit 20 in a storage state and FIG. 1 shows the goal unit 20 in a use state.

First, goal post 600 must be raised to a desired height. Referring to FIG. 6, goal post lift 620 may be utilized to raise the goal post 600 to a desired height. Lift mechanism 626 may be engaged to cause the upward displacement of goal post lift 620, which being joined to goal post 600 at goal post and goal post lift connection point 632 causes the upward movement of goal post 600. Referring to FIG. 3B, it can be seen that goal post 600 is provided with goal post height selector holes 604 A, B and C, which may be selectively engaged by the pin of collar 606 when goal post height selector holes 604 are in alignment with collar 606. The goal post is retained at a desired position by aligning a goal post height selector hole 604 of desired height with the hole in collar 606 and securing the goal post 600 in position by threading a pin through the goal post height selector hole 604 and collar 606 hole. It can be appreciated that a goal post 600 may be provided with goal post height selector holes 604 of various arrangements, allowing the height of goal post 600 to vary and, further, to define discreet heights to which goal post 600 may be raised.

Second, backboard 810 must assume a deployed state. Referring to FIG. 6, backboard 810 is depicted in a semi-folded state, specifically backboard 810 is shown having segments 810B and 810A being angled relative to one another. Backboard 810 may assume a deployed state, shown in FIG. 3B, by bringing backboard segments 810A, 810B and 810C into planar alignment and further locking backboard segments 810A, B and C in that orientation by engaging backboard section latch pins 820 as shown in FIG. 3B. This locks backboard 810 segments A, B and C in planar orientation relative to one another in a deployed state.

Third, goal 800 must be placed in a lowered position for play. Goal 800 may have a stored or lowered, play position. Referring to FIG. 27, goal 800 is depicted in a stored position with rim storage pin 896 protruding through, from the back to the front, backboard 810 to support goal 800 in an upright configuration. Another view of this arrangement is depicted in FIG. 26. To transition goal 800 from an upright, stored position to a lowered, play position, rim storage pin 896 is withdrawn from underneath goal 800, being moved toward the rear of backboard 810, thus allowing goal 800 to freely pivotally move around goal hinge 890 and permitting goal 800 to rotate downward to a lowered position for play. The goal 800 may be secured in a play position by engaging the latch portion of goal 800 and goal latch 894 with goal latch pin 892.

Fourth, lift mechanism 700 must assume a raised state. Lift mechanism 700 is depicted in a raised state in FIG. 6. Lift mechanism 700 is shown in a lowered state in FIG. 26. Lift mechanism 700 may be transitioned from a lowered state to a raised state by first disengaging lift latch 716 from engagement on front lower arm 708, thereby permitting the lift mechanism 700 to move freely. Further, lift mechanism 700 may be transitioned from a lowered state to a raised state by moving lift handle 702 downward motion. As shown in FIG. 6, lift handle 702 is lockably connected around goal post 600. Thus, the lift mechanism 700 is configured in a raised state as shown in FIG. 6.

With these steps in mind, it can be appreciated that a person could equally transition a goal unit 20 from a use state to a storage state.

Figure 30:
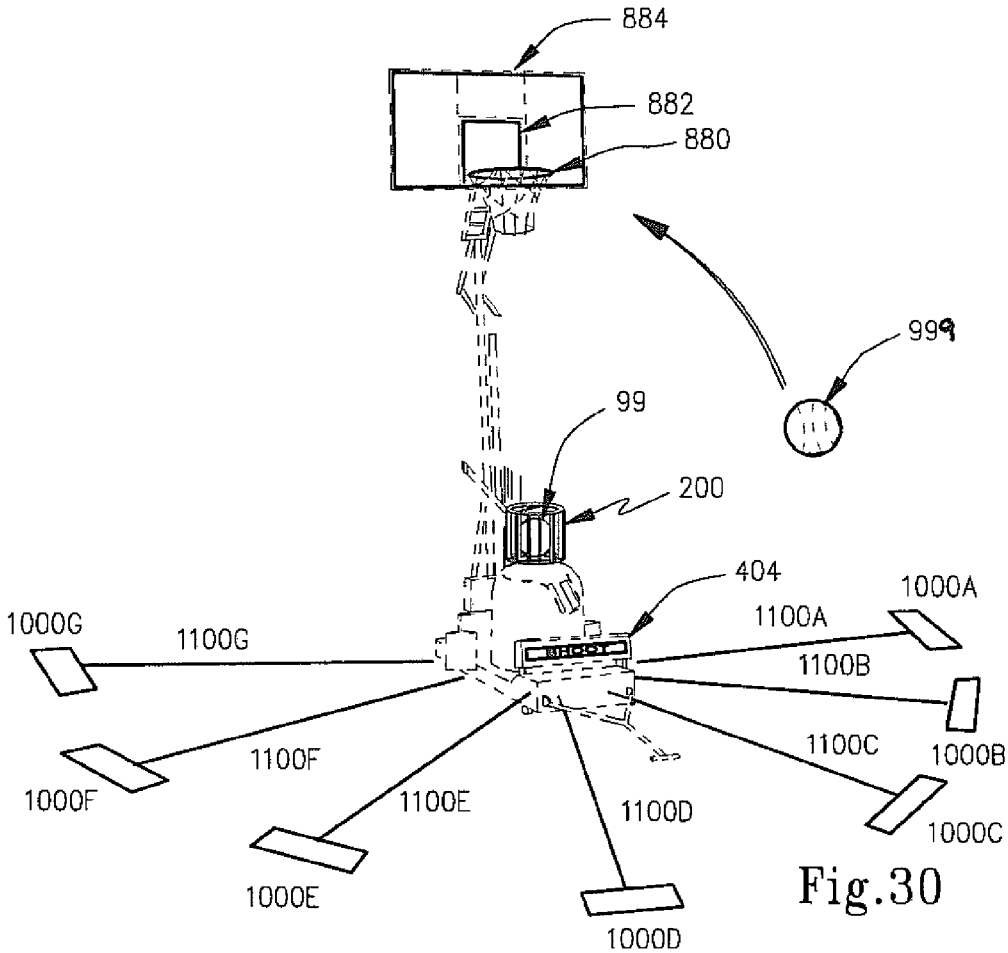
FIG. 30 is a perspective view of the visible elements of the third embodiment of the present disclosure.

A third exemplary embodiment of the present disclosure is providing either or both a basketball return machine 10 and goal unit 20, as discussed herein, with features that permit one or both to be utilized in low lighted environments or environments having no light whatsoever. FIG. 30 depicts the way in which ball return machine 10 and goal unit 20 may be adapted to function in a no or low light environments, utilizing conventional or glow basketballs 999, basketballs that emit light when exposed to ultra-violet light.

A secondary function of escapement 200 is the illumination of glow basketballs 999 with ultra-violet light. As suggested in FIG. 12, escapement 200 may be provided with six ultra-violet fluorescent tubes 290 that, when operative, emit UV illumination, which has the effect of "charging" the luminescent effect of the glow basketballs 999. When supported in escapement 200, as depicted in FIG. 8, glow basketballs 999 are exposed to ultra-violet light, pending release into projecting device. This is a sufficient charging period that the balls will "glow-in-the-dark" when launched from projecting device 300 and utilized in conjunction with basketball return machine 10 and/or goal unit 20.

As shown in FIG. 30, each of the seven indicated delivery direction indicator 1100A-G may be equipped with an illuminated visual indicator, or may themselves illuminate, showing the direction in which the ball will be launched by the projecting device 300. This may be in the form of an electroluminescent wire which is stretched outward from the projecting device 300 toward the player at the indicated delivery location 1000. Additionally, each delivery location 1000A-G may also illuminate.

Figure 29:
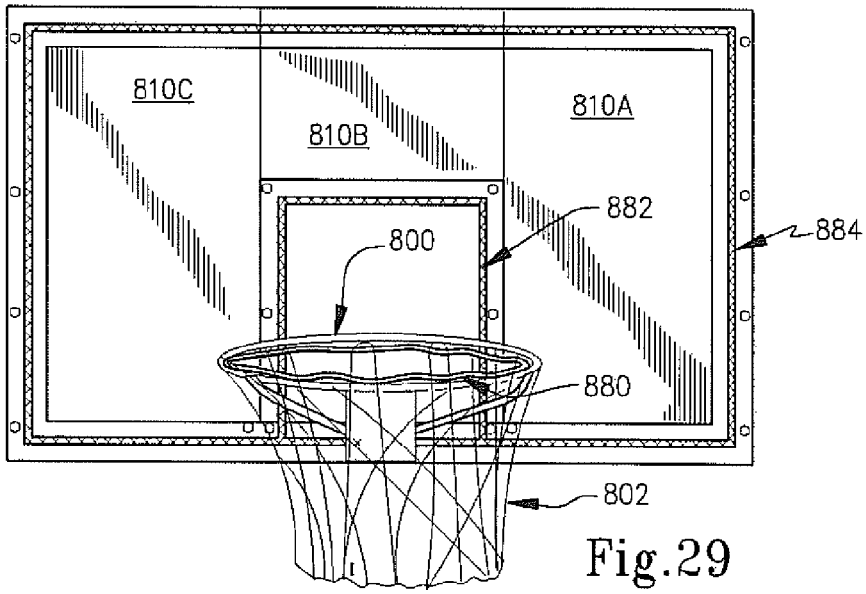
FIG. 29 is a frontal view of the configuration of lighting elements on a backboard and goal.

Furthermore, there may also be electroluminescent wire outlining and illuminating the backboard 810, shown in FIG. 30 as 882 and 884, and the goal 800, shown in FIG. 30 as 880. FIG. 29 shows a lighted view of backboard 810 and goal 800, permitting one to see how lighting elements, such as electroluminescent wire or lights, depicted as 880, 882 and 884, may be configured to illuminate backboard 810 and goal 800 in low or no light environments.

Referring to FIG. 30, this electroluminescent illumination of the backboard 810 and goal 800, in conjunction with the illumination of delivery direction indicator 1100A-G and the display 404 permits critical parts of the ball return machine 10 and goal unit 20 to be visible in low light or no light conditions. Thus, with these illuminated features, or others, it is possible for a person to utilize the basketball return machine 10 and/or goal unit 20, as discussed previously herein, to shoot basketballs, conventional 99 or glowballs 999, toward a goal 800 and have basketballs returned to them at locations around the periphery of the basketball projecting device 10. It is contemplated that more or less sources of light could be employed. Further, it is expressly contemplated that delivery direction indicators 1000A-G could light up randomly or in ordered sequences, indicating shooting positions, success, providing visual entertainment, and the like.

It is contemplated that all components described herein as being moveable or adjustable can equally be configured to be non-movable, having fixed orientations and/or lengths. Where structural elements disclosed herein suggest that they have a particular cross sectional configuration, for example: round, obround, round with slot, oval, oval with flat sides, square, and the like, it is contemplated that all other cross sectional configurations may equally be employed. The above disclosures have contemplated the use of basketballs in conjunction with the various disclosures provided herein, but it should be appreciated that the above disclosures may equally be utilized in conjunction with various other inflated or resilient balls and projectiles, including but not limited to: soccer balls, baseballs, softballs, golf balls, volleyballs, footballs, tennis balls and the like.

Accordingly, the present disclosures have been described with some degree of particularity directed to the preferred embodiments of the present disclosures. It should be appreciated, though, that the present disclosure is defined by the following claims construed in light of the prior art so that modifications or changes may be made to the preferred embodiment of the present disclosure without departing from the inventive concepts contained herein.

We claim:

1. A basketball return machine, comprising:

a. a base platform transportable along a playing surface;

b. a basketball goal mounted to said base platform;

c. a basketball collector connected to said base platform and located beneath said basketball goal to receive basketballs shot toward the basketball goal;

d. a motorized projecting device mounted to said base platform and positioned to receive basketballs from said basketball collector and deliver them toward at least one delivery location on the playing surface, thereby enabling practice shots from such location without requiring a shooter to retrieve shot basketballs;

e. an escapement positioned between said basketball collector and said projection device for dispensing received basketballs into said projecting device; and f. a yoke coupled to said basketball collector and configured to direct received basketballs into said escapement, said yoke being supported by an upwardly extending mast that is connected to said base platform.

2. The basketball return machine according to claim 1 wherein said yoke couples a lower end of said basketball collector to said escapement to permit the received basketballs to be fed into said escapement wherein said escapement is suspended from said yoke.

3. The basketball return machine according to claim 1 wherein said basketball collector includes a netted framework which spans beneath said basketball goal and tapers downwardly toward said escapement, and including downwardly sloped chute interfaced between said netted framework and said escapement for funneling received basketballs into said escapement.

4. The basketball return machine according to claim 1 wherein said basketball collector includes a netted framework which spans beneath the basketball goal and tapers downwardly toward said escapement, said netted framework including an upper portion having a rectangular geometry, and a lower portion having an upside down, truncated pyramidal geometry.

5. The basketball return machine according to claim 1 wherein said escapement is constructed as a cylindrical shell having an interior channel through which the collected basketballs are received, said escapement including a plurality of armatures operative to engagedly retain basketballs within the escapement.

6. The basketball return machine according to claim 5 including a set of upper armatures and a set of lower armatures electromechanically coupled to one another such that a plurality of said basketballs can be retained within said above, each in a respective waiting state, prior to being dropped into said projecting device.

7. The basketball return machine according to claim 6 wherein said upper and lower sets of armatures are operative to move from a basketball engage position, to retain an associated upper or lower basketball in the waiting state, to a basketball disengaged state to permit the associated upper or lower basketball to move downwardly toward said projecting device.

8. The basketball return machine according to claim 6 wherein the armatures within said upper set are equiangularly spaced about a central longitudinal axis of said escapement, and wherein the armatures within said the lower are equiangularly spaced about the central longitudinal axis.

9. The basketball return machine according to claim 1 wherein said collector includes a netted framework for spanning beneath the basketball goal, said return machine adapted to move from a collapsed configuration, wherein said netted framework is in a folded state, to an expanded configuration, wherein said netted framework is in a deployed state.

10. The basketball return machine according to claim 9 wherein said netted framework tapers downwardly toward said escapement, and includes an upper portion having a rectangular geometry, and a lower portion having an upside down, truncated pyramidal geometry.

11. The basketball return machine according to claim 10 wherein said netted framework includes a plurality of extension arms each formed as a respective sub-assembly and adapted to move from a retracted state to an extended state as said framework moves from the folded state to the deployed state.

12. The basketball return machine according to claim 11 wherein each arm sub-assembly includes a proximal end, a distal end, and a plurality of arm segments therebetween, a wherein each terminal arm segment forms an upright corner support for said netted framework's upper portion in the deployed state, and wherein proximal ones of said arm segments form side edges for the netted framework's lower portion in the deployed state.

13. The basketball return machine according to claim 1 wherein said return machine is adapted to move from a collapsed configuration to facilitate transport along the playing surface, to an expanded configuration for use.

14. The basketball return machine according to claim 13 wherein said collector includes a netted framework for spanning beneath the basketball goal, said netted framework adapted to move from a folded state when said return machine is in the collapsed configuration, to one of a plurality of deployed states when said return machine is in the expanded configuration, and wherein said basket ball goal is selectively adjustable in height.

15. The basketball return machine according to claim 14 wherein each of said netted framework and said basketball goal is adapted to be selectively adjustable in height between discrete deployment positions to accommodate different player skill levels.

16. A basketball return machine, comprising:

a. a transport device transportable along a playing surface;

b. a basketball goal supported by a goal post mounted to said transport device;

c. a basketball collector connected to said transport device and located beneath said basketball goal to receive basketballs shot toward the basketball goal;

d. a motorized projecting device mounted to said transport device and positioned to receive basketballs from said basketball collector and deliver them toward at least one delivery location on the playing surface, thereby enabling practice shots from such location without requiring a shooter to retrieve shot basketballs;

e. an escapement positioned between said basketball collector and said projection device for dispensing received basketballs into said projecting device; and f. a yoke coupled to said basketball collector and configured to direct received basketballs into said escapement, said yoke being supported by an upwardly extending mast that is connected to said transport device.

17. A basketball return machine according to claim 16 wherein said transport device is manually transportable along the playing surface.

18. A basketball return machine according to claim 17 wherein said transport device includes at least one wheeled base platform to permit rolling transport of said apparatus along the playing surface.

19. A basketball return machine according to claim 17 wherein said transport device includes a pair of base platforms, a first one of said platforms supporting said basketball goal, and a second one of said platforms supporting said basketball collector and said projecting device.

20. A basketball return machine according to claim 19 wherein said base platforms are removably attachable to one another.

21. A basketball return machine according to claim 20 wherein each of said pair of base platforms includes a plurality of wheels to permit rolling transport of said basketball return machine along the playing surface.

22. A basketball return machine according to claim 18 including a handle associated with said at least one wheeled base platform to facilitate manual transport of said basketball return machine along the playing surface.

23. A basketball return machine, comprising:

a. a base platform transportable along a playing surface;

b. a basketball goal mounted to said base platform;

c. a basketball collector connected to said base platform and including a netted framework for spanning beneath the basketball goal to receive basketballs shot toward the basketball goal, said basketball collector can be moved from a collapsed configuration, wherein said netted framework is in a folded state, to an expanded configuration, wherein said netted framework is in a deployed state;

d. a motorized projecting device mounted to said base platform and positioned to receive basketballs from said basketball collector and deliver them toward at least one delivery location on the playing surface, thereby enabling practice shots from such location without requiring a shooter to retrieve shot basketballs;

e. an escapement positioned between said basketball collector and said projection device for directing received basketballs into said projecting device;

f. a yoke coupled to said basketball collector and configured to direct received basketballs into said escapement, said yoke being supported by an upwardly extending mast that is connected to said base platform; and g. a pedestal extending from said base platform, said pedestal pivotably supporting said mast and said netted framework.

* * * * *